US006776100B2

(12) United States Patent
Cutcher

(10) Patent No.: US 6,776,100 B2
(45) Date of Patent: Aug. 17, 2004

(54) METHOD AND APPARATUS FOR TRANSFERRING AN IMAGE TO A SUBSTRATE

(76) Inventor: Thomas V. Cutcher, 5045 Summerfield Rd., Petersburg, MI (US) 49270

( * ) Notice: Subject to any disclaimer, the term of this patent is extended or adjusted under 35 U.S.C. 154(b) by 0 days.

(21) Appl. No.: 10/325,581

(22) Filed: Dec. 19, 2002

(65) Prior Publication Data

US 2003/0116047 A1 Jun. 26, 2003

Related U.S. Application Data

(60) Provisional application No. 60/344,217, filed on Dec. 21, 2001.

(51) Int. Cl.[7] ..... B41D 7/00

(52) U.S. Cl. ..... 101/492; 101/493; 101/34; 156/230

(58) Field of Search ..... 101/492, 493, 101/488, 128.21, 129, 31, 34, 28; 156/230, 229, 240, 247, 272.2, 494, 277, 289, 583.1, 228, 238; 427/148

(56) References Cited

U.S. PATENT DOCUMENTS

| | | | | |
|---|---|---|---|---|
| 373,236 A | | 11/1887 | Jacobson | |
| 2,519,661 A | | 8/1950 | Johnson | |
| 2,739,532 A | | 3/1956 | Fernandez | |
| 2,745,339 A | | 5/1956 | Fernandez | |
| 2,904,916 A | | 9/1959 | Stahlmann | |
| 3,330,712 A | | 7/1967 | Rowe | |
| 3,688,695 A | | 9/1972 | James | |
| 3,745,970 A | | 7/1973 | Scantlebury | |
| 3,765,165 A | | 10/1973 | Vial | |
| 3,813,268 A | * | 5/1974 | Kerwin | 156/238 |
| 3,868,901 A | | 3/1975 | Valiela | |
| 4,060,031 A | | 11/1977 | Philipp | |
| 4,098,184 A | | 7/1978 | Okada et al. | |

(List continued on next page.)

FOREIGN PATENT DOCUMENTS

| | | |
|---|---|---|
| EP | 251780 A1 | 7/1988 |
| EP | 031228 A2 | 11/1989 |
| EP | 370007 B1 | 5/1990 |
| EP | 495111 B1 | 7/1992 |
| EP | 0635378 A2 | 1/1995 |
| EP | 0891881 A1 | 1/1999 |
| EP | 1171305 B1 | 4/2000 |
| EP | 1 171 305 B1 | 10/2002 |
| EP | 1173336 B1 | 12/2002 |
| JP | 2-61916 | 12/1990 |
| JP | 3-202382 | 9/1991 |
| JP | 5-31879 | 2/1993 |
| JP | 6-8697 | 1/1994 |
| JP | 6-15945 | 1/1994 |
| JP | 6-71784 | 3/1994 |
| JP | 8-118779 | 5/1996 |
| JP | 2001096884 | 4/2001 |
| WO | WO 0058095 | 10/2000 |

OTHER PUBLICATIONS www.serviceuk.com, Total Transfer Technology, pp. 1–2.
www.serviceuk.com/tt400.html, TT400 Offset Screen Printing Machine, p. 1.

(List continued on next page.)

*Primary Examiner*—Eugene H. Eickholt
(74) *Attorney, Agent, or Firm*—Marshall & Melhorn, LLC

(57) ABSTRACT

An apparatus for, and a method of, transferring an image to a substrate. At least one printed, flexible membrane is located adjacent at least one forming fixture having a complementary shape to the substrate surface. The membrane is urged into image transferring contact with the substrate.

111 Claims, 22 Drawing Sheets

U.S. PATENT DOCUMENTS

| | | | | | |
|---|---|---|---|---|---|
| 4,314,504 | A | | 2/1982 | Combeau | |
| 4,314,814 | A | | 2/1982 | Deroode | |
| 4,365,554 | A | | 12/1982 | Siegal et al. | |
| 4,541,340 | A | | 9/1985 | Peart et al. | |
| 4,557,195 | A | | 12/1985 | Phlipp | |
| 4,615,266 | A | | 10/1986 | DeRoche et al. | |
| 4,803,922 | A | | 2/1989 | Dennesen | |
| 4,896,598 | A | | 1/1990 | Leech, Jr. | |
| 5,054,390 | A | | 10/1991 | Birtles et al. | |
| 5,088,401 | A | | 2/1992 | Fujino et al. | |
| 5,272,973 | A | | 12/1993 | Chojnacki | |
| 5,293,818 | A | | 3/1994 | Mandzuk | |
| 5,382,313 | A | * | 1/1995 | Eminger | 156/583.1 |
| 5,392,706 | A | | 2/1995 | Drew, II et al. | |
| 5,456,170 | A | | 10/1995 | Bachmann | |
| 5,476,040 | A | | 12/1995 | Kleist | |
| 5,486,254 | A | * | 1/1996 | Gallagher et al. | 156/230 |
| 5,537,921 | A | | 7/1996 | Adner et al. | |
| 5,577,442 | A | | 11/1996 | Tanaka et al. | |
| 5,637,265 | A | | 6/1997 | Misciagno et al. | |
| 5,642,141 | A | | 6/1997 | Hale et al. | |
| 5,653,167 | A | | 8/1997 | De Volder | |
| 5,694,839 | A | | 12/1997 | Wohl et al. | |
| 5,802,972 | A | | 9/1998 | Hoffmann et al. | |
| 5,921,177 | A | | 7/1999 | Shin | |
| 5,943,957 | A | | 8/1999 | Mason | |
| 6,035,777 | A | * | 3/2000 | King | 101/34 |
| 6,276,266 | B1 | | 8/2001 | Dietz et al. | |
| 6,524,419 | B1 | * | 2/2003 | Dabrowski, Jr. et al. | 156/230 |

OTHER PUBLICATIONS www.serviceuk.com/tt200.html, TT200 Offset Screen Printing Machine, p. 1.

Heinz Grop, Pad Printing Impresses The Plastic Industry, Plastics Engineering, Jun. 1987, pp. 39–41.

Peter Kiddell & Carol Swift, Understanding Glass and Ceramic Decorating, ScreenPrinting, pp. 33–37.

Manas Chanda & Salil K. Roy, Plastics Technology Handbook, 1997, 333–343, Marcel Dekker, New York.

* cited by examiner

METHOD AND APPARATUS FOR TRANSFERRING AN IMAGE TO A SUBSTRATE

RELATED APPLICATION

This application is claiming the benefit, under 35 U.S.C. § 119(e), of the provisional application filed on Dec. 21, 2001, under 35 U.S.C. § 111(b), which was granted Serial No. 60/344,217, and is hereby incorporated by reference in its entirety.

BACKGROUND OF THE INVENTION

1. Field of the Invention

The present invention relates to an apparatus for, and a method of, transferring an image to a substrate. More particularly, the present invention relates to an apparatus for, and a method of, transferring at least one image to at least one substrate having a planar and/or curved surface such as, for example, a complexly curved surface. A flexible membrane, having an image printed thereon, is shaped by at least one forming fixture into a complementary shape to the substrate. A means to transfer the image from the shaped membrane to the substrate is provided.

2. Discussion of the Related Art

Various methods of transferring an image to a substrate have long been known. These methods have also included transferring images to substrates having flat, curved and uneven surfaces. The known methods are limited in their ability to transfer a high-quality image to a substrate of a particular size, having complex curves, having radii of a particular value, and/or to transfer the image to the edge of the substrate.

Examples of conventional image transfer apparati and methods are disclosed in, for example:

U.S. Pat. No. 6,276,266 teaches a pad printing system utilizing a programmable digital color printer for applying multicolor images to curved objects. The '266 patent, however, does not teach or suggest the use of a forming fixture or a deformable membrane for transferring an inked image.

U.S. Pat. No. 5,921,177 teaches a pad printing machine having a print moving plate moveable back and forth and a printing pad moveable up and down, allowing the printing pad to print on an object while the print moving plate moves forward. The back and forth and up and down movement is controlled by a double-sided cam and roller system. The '177 patent does not teach or suggest the use of a forming fixture or a deformable membrane for transferring an inked image. Further the control of movement of the various components of the present apparatus are controlled in a manner substantially different from that disclosed in the '177 patent.

U.S. Pat. No. 5,694,839 teaches a method and apparatus for printing images around cylindrical items, the apparatus including a gravure plate, a flexible ink transfer pad for receiving an ink image from the gravure plate and transferring the image onto a flat silicon ink transfer plate, and rolling the cylindrical item in a continuous operation across the transfer plate, causing the desired pattern to be printed on the cylindrical item. The '839 patent does not, however, teach or suggest the use of a forming fixture.

U.S. Pat. No. 5,088,401 teaches a method and apparatus for a moveable printing plate having a detector which senses initial contact between the printing plate and a workpiece in order to accommodate variations in thickness of workpiece while purportedly ensuring uniformity of the pattern printed on such work piece. The '401 patent does not, however, teach or suggest the use of a forming fixture or a deformable membrane for transferring an inked image.

U.S. Pat. No. 5,054,390 teaches a method of creating large differences in the ink affinity of deformable, silicone rubber printing pads by utilizing different catalysts in the curing of the rubber. The rubber pads are utilized to transfer an inked image from an intermediate surface to an article. A method and apparatus for printing utilizing the pads having varying ink affinities is also disclosed. The '390 patent is silent, however, on how membranes are deformed to conform to the shape of a substrate surface.

U.S. Pat. No. 4,896,598 teaches a process for printing an image on the surface of an article by applying a thixotropic thermal curable ink comprising a pigment and a catalyst to a printing plate having a recess in the form of the image to be printed. The '598 patent does not teach, however, the use of a forming fixture or a deformable membrane for transferring an inked image.

U.S. Pat. No. 4,060,031 discloses a method and apparatus for printing materials wherein a matrix material has depressions in the shape of the image to be printed, which depressions are filled with ink. A printing pad having a surface normally repellent to ink is pressed onto the inked matrix causing the image to be transferred to the pad and thence from the pad to the surface of the article to be printed. The '031 patent does not, however, teach the use of a forming fixture.

Accordingly, it would be advantageous to have a method to transfer a high quality image onto a substrate by printing on a flat membrane, and subsequently shaping the membrane with a forming fixture to conform with the surface of the substrate and transferring the image thereon through the application of pressure. This method would not be limited by the size or shape of the substrate upon which the image would be transferred.

SUMMARY OF THE INVENTION

The present invention is an apparatus and method for transferring a high-quality image to a substrate having a surface. The surface may be substantially planar, curved or a complexly curved surface such as, for example, the inside or outside surface of a concave substrate, a convex substrate, or a compound substrate.

In an embodiment of the invention, a membrane is located in a print station where an image is printed on the membrane using a pigment-containing material. If required, during the image transfer steps described in more detail below, the print station can simultaneously maintain the pigment-containing material in a print-ready condition by selectively printing on a medium at predetermined times.

The printed membrane is moved to a transfer station having at least one forming fixture and at least one substrate fixture. The substrate fixture is removably connected to a means for locating the substrate fixture adjacent the printed membrane. A separate substrate fixture for each substrate having a particular shape and curvature is attached to the locating means.

One or more forming fixtures shape the printed membrane into a complementary shape to the substrate. The forming fixture is designed to shape the entire membrane, or portions of the membrane, for substantially simultaneous or successive contact with the substrate to transfer at least one image. Pressure is added to the substrate fixture/membrane/forming fixture combination to effect the transfer. After the image is transferred to the substrate, the pressure is released. The substrate having the transferred image thereon is removed from the substrate fixture. Where layers of images are desired, where images are desired in more than one location, and/or where a different pigment-containing material is desired on the substrate, different portions of the first membrane or, at least a second membrane is used.

BRIEF DESCRIPTION OF THE DRAWINGS

The above, as well as other advantages of the present invention, will become readily apparent to those skilled in the art from the following detailed description when considered in the light of the accompanying drawings in which.

DETAILED DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1:
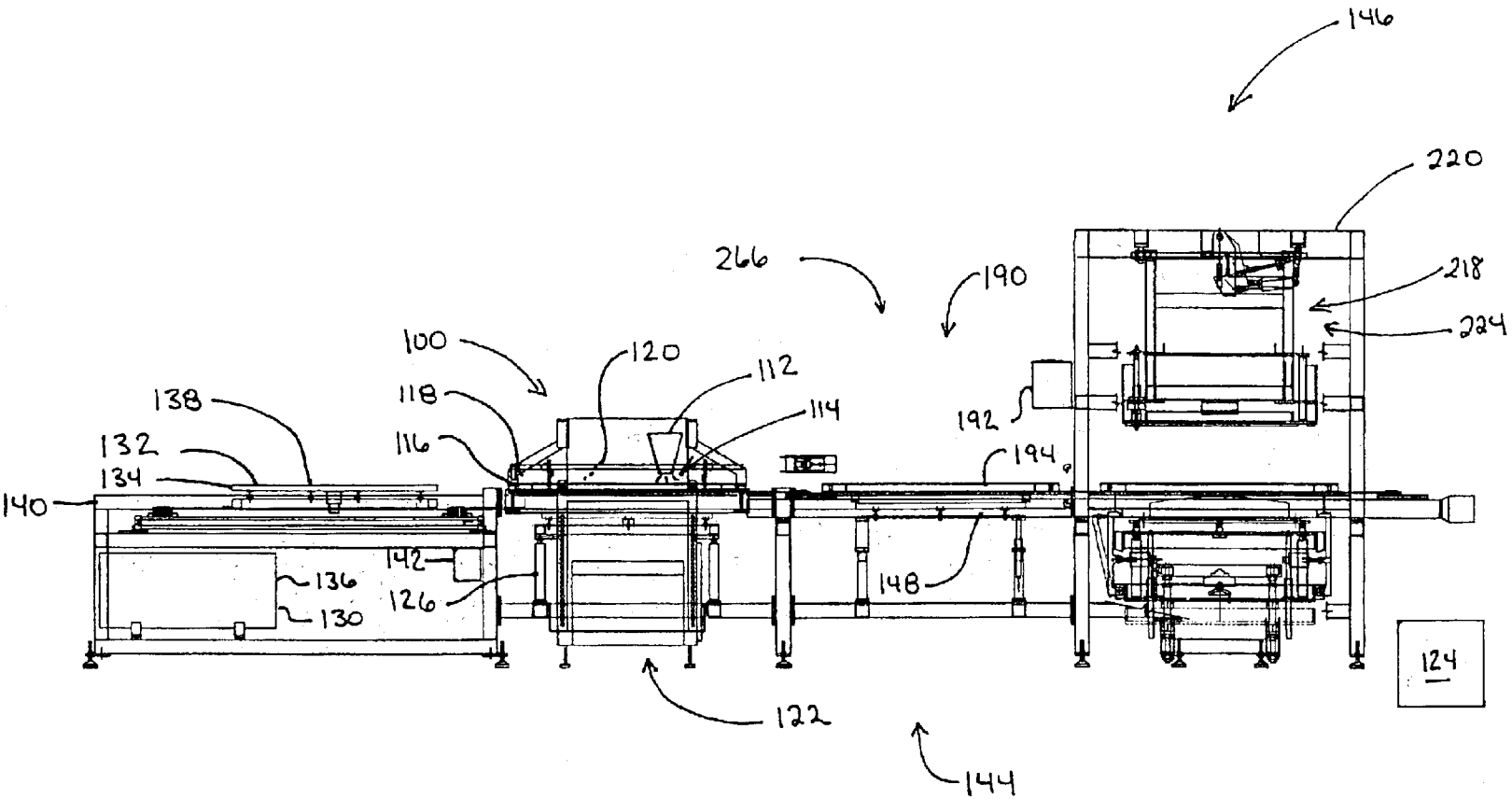
FIG. 1 is a side view of a construction embodying the present invention.
Figure 2:
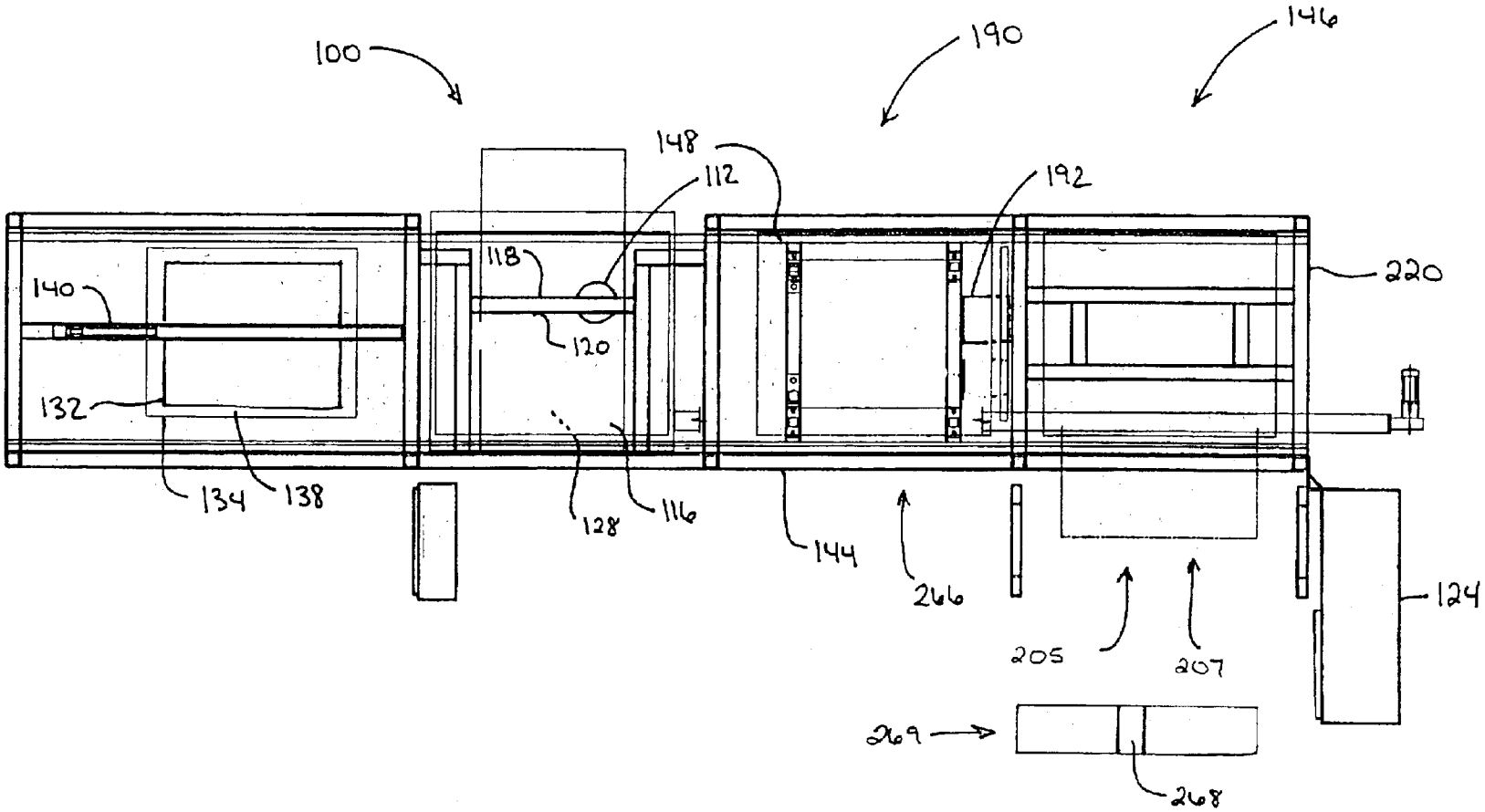
FIG. 2 is a top view of the construction embodying the invention of FIG. 1.
Figure 10:
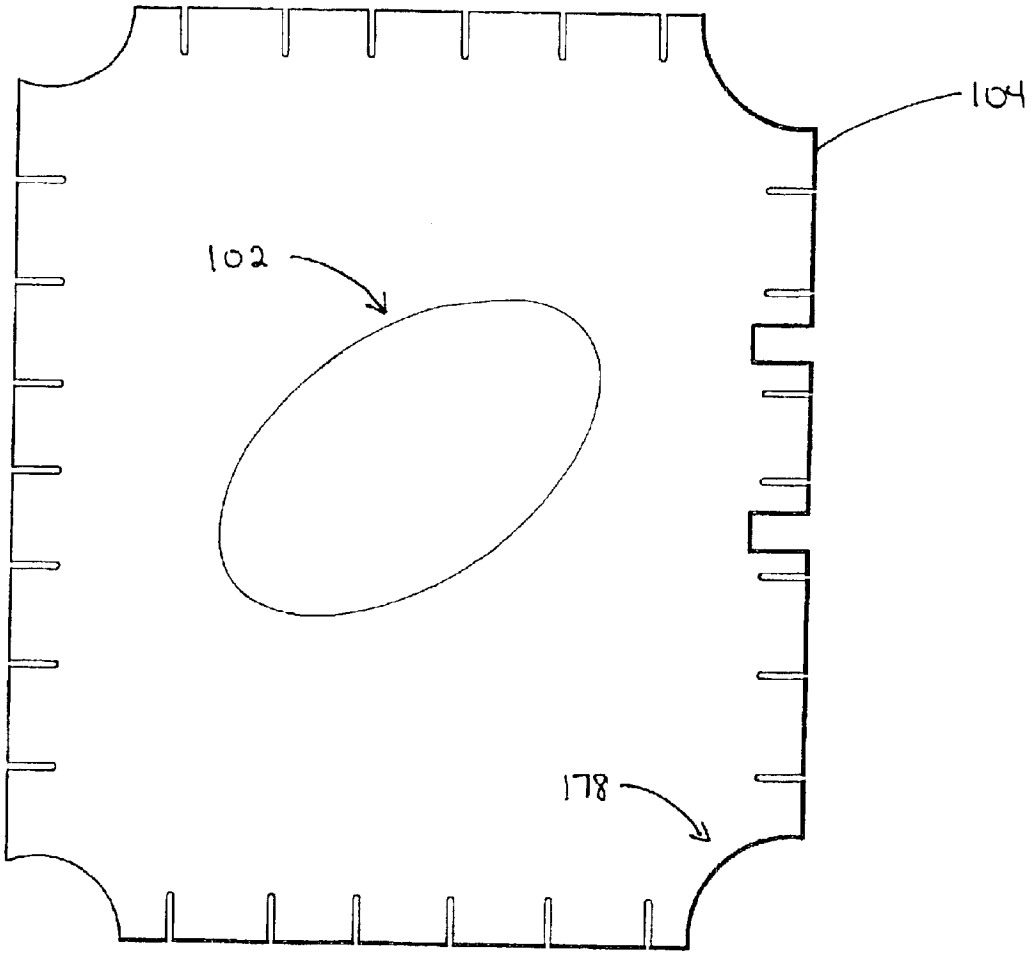
FIG. 10 is a top view of a portion of the construction shown in FIG. 1.

Referring to FIGS. 1, 2 and 10 an embodiment of the present invention is depicted having at least one print station 100 for printing at least one image 102 on at least one flexible membrane 104. The print station 100 may be such as a Saturn Screen Printing Machine available from M&R Printing, Inc. of Glen Ellyn, Ill. Other printing machines and methods, such as, for example, machines with at least one print head 106 as known to those skilled in the art of printing may be used without departing from the scope or spirit of the invention. In another embodiment of the invention depicted in FIG. 3, the print station 100 has at least one screen printing portion 108 and at least one print head portion 110.

Figure 4:
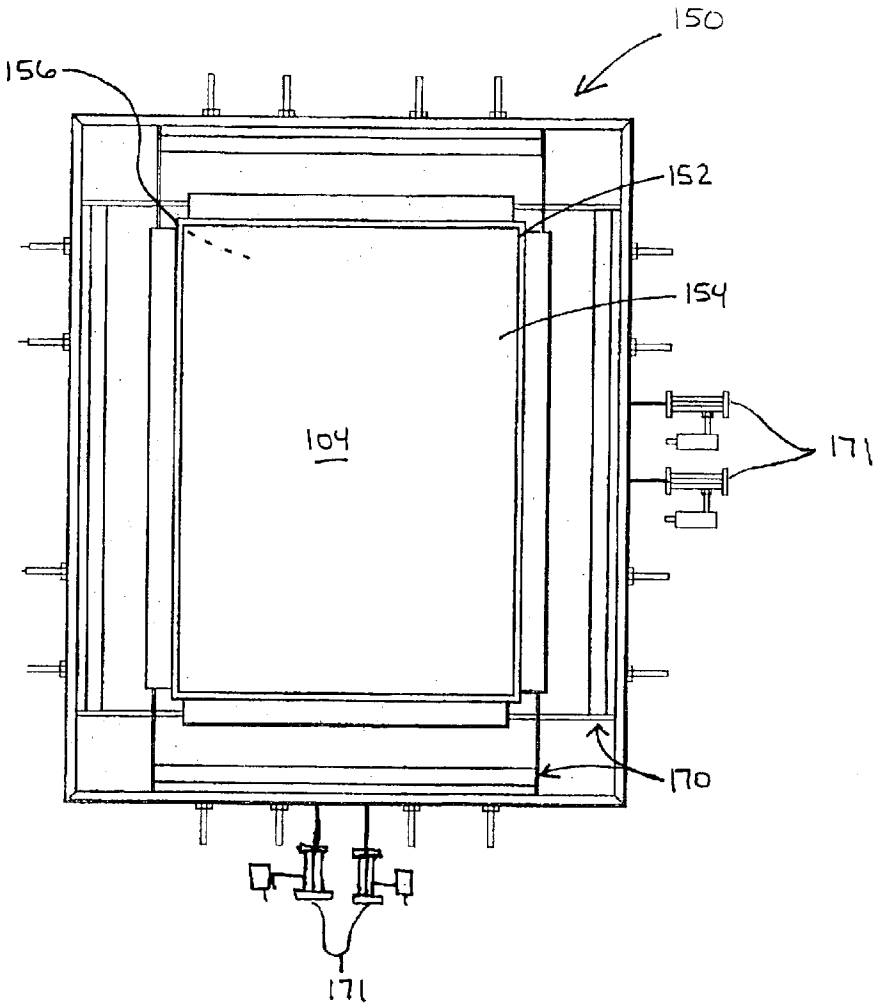
FIG. 4 is a top view of a portion of the construction shown in FIG. 1.

As seen in FIGS. 1, 2 and 4, the print station 100 preferably has a membrane 104 and at least one device 112 for locating pigment-containing material 114, such as printing ink, on a screen 116. The pigment-containing material 114 may be, for example, Coates Screen HG-N50 from Coates Screen of St. Charles, Ill., however, other pigment containing materials 114 may be used without departing from the scope and spirit of the invention. The device 112 may be, for example, one or more gravity fed drip tubes or at least one pigment-containing material spraying device as known in the art. The print station 100 also preferably has at least one device 118 for spreading the pigment-containing material 114 substantially across the screen 116. This device 118 may be, for example, a flood bar as known by those skilled in the art, although other means for spreading the pigment-containing material 114 may be used. A squeegee 120 is located above the screen 116 and it may be connected to the flood bar or it may operate independently of the flood bar.

The print station 100 also has a vertically translatable support table 122 located beneath the screen 116. The vertical translation is preferably supplied by at least one controller-actuated 124, pneumatically driven piston 124, however, other translation means such as electric motors, hydraulics and manual means may be used. An upper surface 128 of the support table 122 is connected to a source of vacuum 130.

In some instances, printing onto another medium may be desired prior to, and/or after, printing on the membrane 104 to ensure the pigment-containing material 114 does not dry. Preferably, the print station 100 has a means for maintaining the pigment-containing material in a printable condition. The means may include, for example, a medium 132, such as paper, although any medium capable of receiving the pigment-containing material 114 may be used.

In one embodiment, individual sheets of the medium 132 are removably secured on a table by manual or automated means. The table may be, for example, a vacuum table 134 connected to a source of vacuum 136 capable of selectively securing the medium 132 to an upper surface 138. Other means of securing the medium 132 to the table 134, such as clamps, clips, and other mechanical fasteners, are well within the scope of the invention.

The table 134 travels into the print station 100 along a track 140 by either a manual or an automatic source of motion such as, for example, an electric motor and/or at least one pneumatic or hydraulic cylinder.

The source of motion 142 of the vacuum table 134 is manually or automatically controlled or a combination of both. If the vacuum table 134 is automatically controlled, a programmable controller 124 is in communication with the source of motion 142. When activated by the controller 124, the source of motion 142 engages the vacuum table 134 to move it to and from the print station 100 along the track 140.

An alternative medium supply system (not shown) includes unprinted medium on a source spool and a take-up spool. The unprinted medium extends from the source spool to the take-up spool adjacent the screen. The unprinted medium adjacent the screen is printed, passed through several rollers to allow the pigment-containing material to dry, and is then taken up by the take-up spool. This system can be manually or automatically operated. If the system is automatically operated, it is controlled by the programmable controller. The controller is programmed to automatically index the unprinted medium into the print station as required.

FIGS. 1 and 2 depict an embodiment of the present invention having a frame system 144 connecting the print station 100 with at least one transfer station 146. Although the figures depict the print station 100 and the transfer stations 146 in a linear orientation, the stations 100, 146 may be arranged in any orientation without departing from the scope of the present invention.

An alternative embodiment (not depicted) of the present invention includes one or more rotatable platforms connecting the print station and the transfer station. The platform may be automatically or manually controlled. The platform transfers a printed membrane to any of the other stations, described in more detail below, including the transfer station, by rotating the membrane between stations. In this alternative embodiment, the stations are arranged in a substantially non-linear orientation, such as, for example, a circular arrangement around the platform.

Referring back to FIGS. 1 and 2, a transfer means preferably connects the print station 100 with the transfer station 146. The transfer means may be such as a track 148, a means to secure the membrane 104 which is connected to the track 148 and a source of motion. The source of motion may be such as an electric motor, at least one pneumatic or hydraulic cylinder, and/or manual means.

The motion of the transfer means is manually or automatically controlled or a combination of both. If the transfer means is automatically controlled, the programmable controller 124 controls the source of motion.

The means to secure the membrane 104 may be, for example, a frame 150. In FIG. 4, the frame 150 is depicted as substantially square, however, the frame 150 may be any shape to accommodate any membrane 104 design. The frame 150 is preferably constructed of metal, such as an aluminum alloy, although other metal alloys or materials capable of supporting the membrane 104 may be used.

The periphery 152 of the flexible membrane 104 is preferably attached to the frame 150 such that an upper 154 and a lower 156 surface of the membrane 104 are exposed. In a more preferred embodiment, the membrane 104 is releasably attached to each side of the frame 150 with at least one clamp per side.

Figure 5:
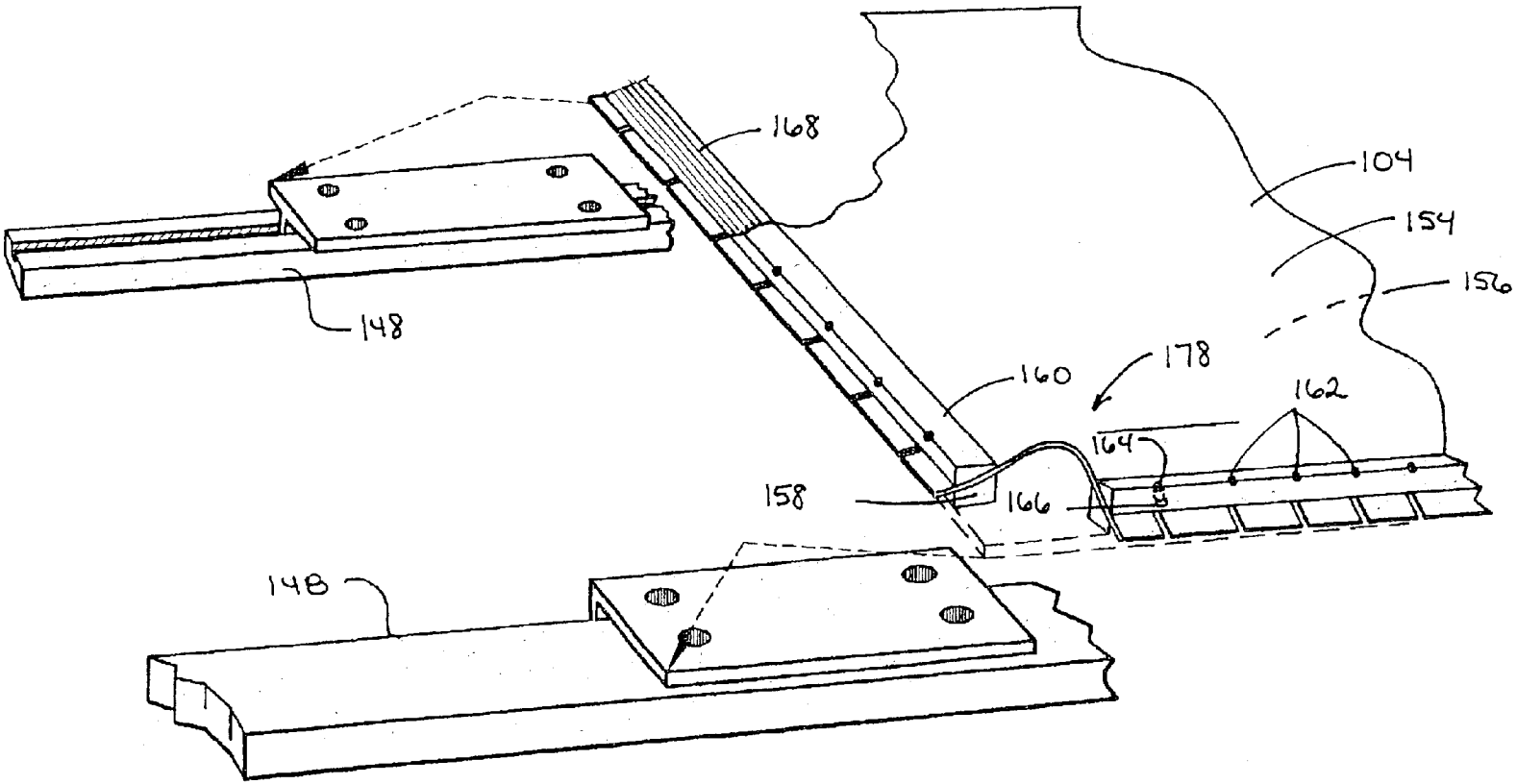
FIG. 5 is a sectional perspective view of a portion of the construction shown in FIG. 1.

In the most preferred embodiment depicted in FIG. 5, the membrane 104 is located between an upstanding portion 158 of the frame 150 and a removable portion 160 having a complementary shape to the upstanding portion 158. The removable portion 160 is located adjacent the membrane 104 and one or more mechanical fasteners 162 are located through holes 164 in the removable portion 160, through the membrane 104 and secured into holes 166 in the upstanding portion 158. Preferably, the mechanical fasteners 162 are screws, however, pegs, rivets, bolts, male/female connectors or other similar devices may be used without departing from the scope of the invention.

The surfaces of the upstanding portion 158 and the removable portion 160 facing the membrane 104 have friction creating devices 168 integrally formed therewith. The friction creating devices 168 may be such as ribs, or other structures having alternating raised and lowered portions, for securely gripping the membrane 104.

Preferably, the membrane 104 is located in a tensioning system for locating and releasing tension in the membrane 104. In one embodiment, the tensioning system has independently operated, pneumatically driven cylinders connected to each side of the membrane 104. In this embodiment, the cylinders may locate and release varying amounts of tension on the membrane 104 at their respective locations.

Figure 6:
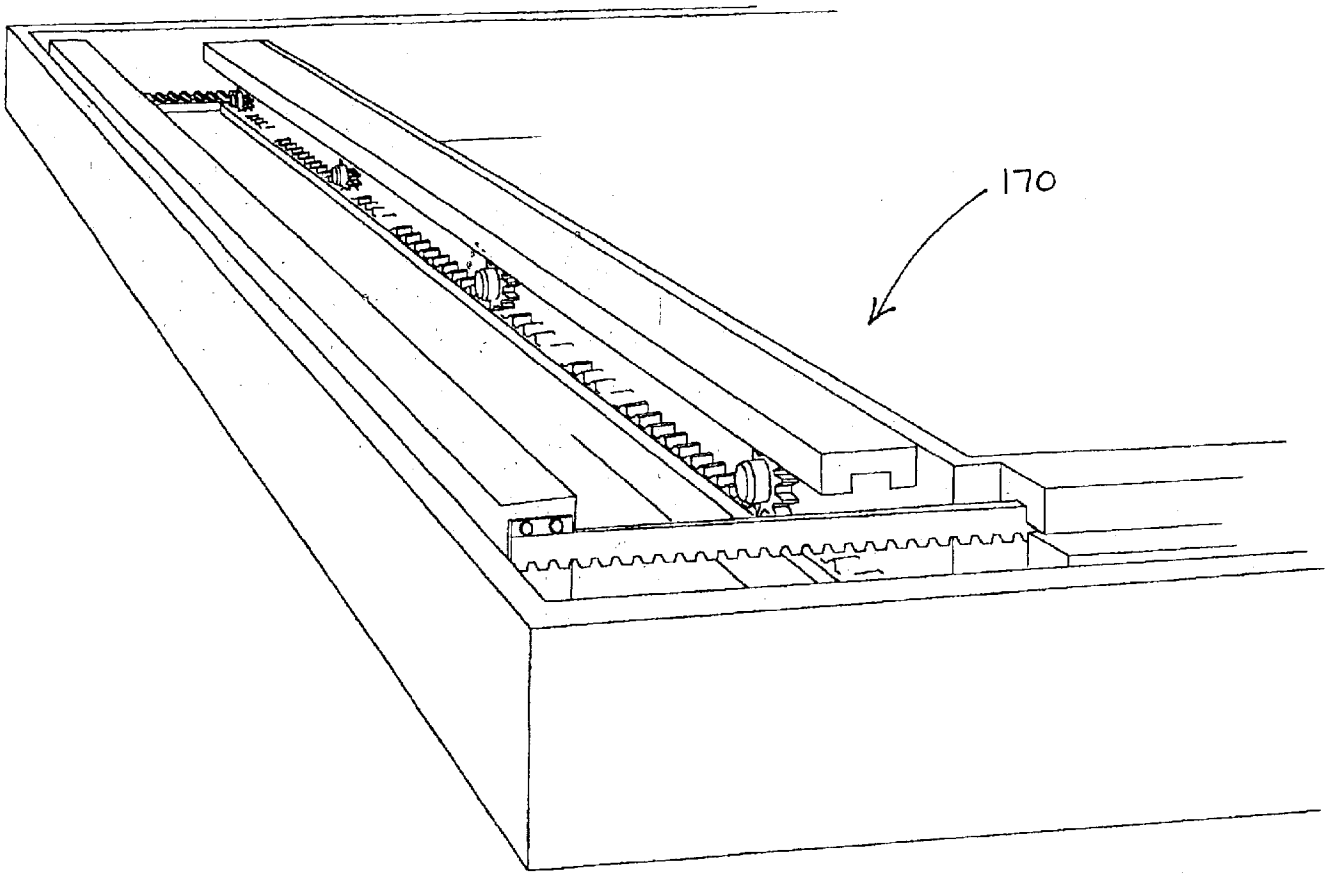
FIG. 6 is a sectional perspective view of a portion of the construction shown in FIG. 1.

In another embodiment, the tensioning system may include, for example, connecting each upstanding portion 158 to a rack and pinion system 170 of the frame 150 as depicted in FIG. 6. The tensioning system moves opposite sides of the frame 150 simultaneously toward or away from each other thereby allowing the frame 150 to create or release a pre-determined amount of tension in the membrane 104. The tensioning system may be moveable by manual means, hydraulic means, electric motor means or a combination thereof, however, pneumatic means are preferred. The pneumatic means may be, for example, one or more automatically controlled pneumatically driven cylinders 171 as shown in FIG. 4. Preferably, the pneumatic cylinders 171 are controlled with the programmable controller 124.

Figures 7, 8, 9:
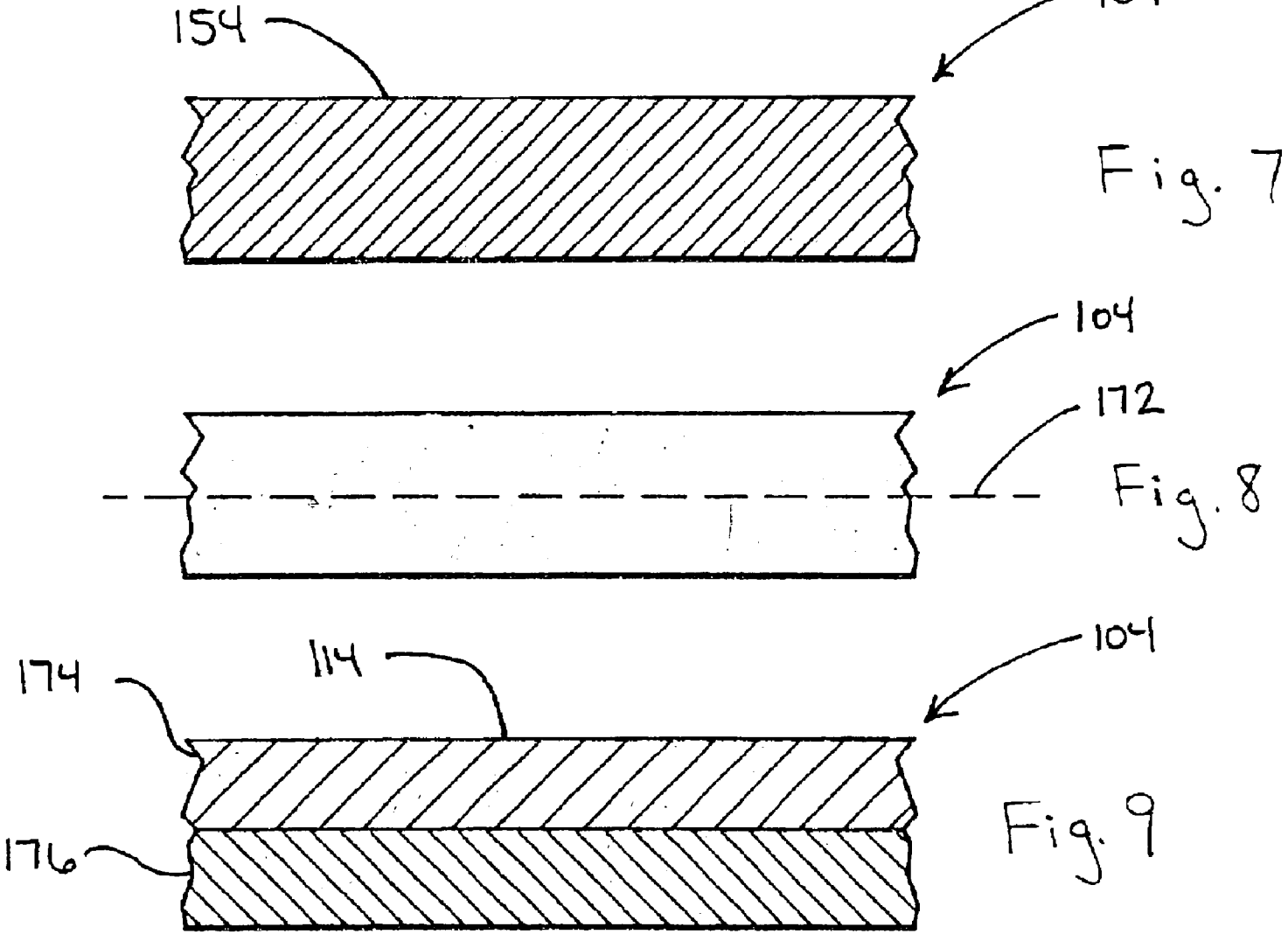
FIG. 7 is a sectional side view of a portion of the construction shown in FIG. 1.
FIG. 8 is a sectional side view of another embodiment of the construction shown in FIG. 7.
FIG. 9 is a sectional side view of another embodiment of the construction shown in FIG. 7.

As shown in FIG. 7, the membrane 104 is constructed of a flexible material capable of being shaped to and/or conforming with a substantially planar, curved and/or complexly curved substrate. In one embodiment, the membrane 104 is constructed of a rubber or silicone compound, however, other materials known in the art having the above-described characteristics may be used without departing from the scope of the present invention.

If desired, a mesh or fabric 172 may be embedded in the membrane 104 to add dimensional stability as shown in FIG. 8. Alternatively, or additionally, the membrane 104 may have at least a first layer 174 designed to carry pigment-containing material 114 thereon and at least a second layer 176 designed to support the first layer 174 depicted in FIG. 9. Preferably, the first layer 174 is harder than the second layer 176 to assist in providing greater resolution of the image 102 to the substrate. The second layer 176 provides flexibility and conformability to the membrane 104. It is within the scope of the present invention to locate the first layer 174 beneath the second layer 176.

In one embodiment, as depicted in FIG. 10, the membrane 104 is designed in a substantially square shape although other shapes required to print on various substrates are well within the scope of this invention. Portions of the corners 178 of a membrane 104, such as a square-shaped membrane 104, may be removed to reduce or prevent distortions of the membrane 104 adjacent its corners 178 when tension is located in the membrane 104 and/or when the membrane 104 is shaped to the surface of the substrate as described in more detail below.

In one embodiment of the present invention shown in FIG. 7, the upper surface 154 of the membrane 104 is substantially planar. In another embodiment of the invention shown in FIG. 11, the upper surface 154 of the membrane 104 has a portion or portions with a first height 180 and a portion or portions with at least a second height 182. The first 180 and second 182 height portions may be arranged in any sequence and/or orientation such as, for example, radially inward or outward from one another. The membrane 104 may have any number of portions in any sequence or orientation with the first 180 and second 182 portions.

Figure 11:
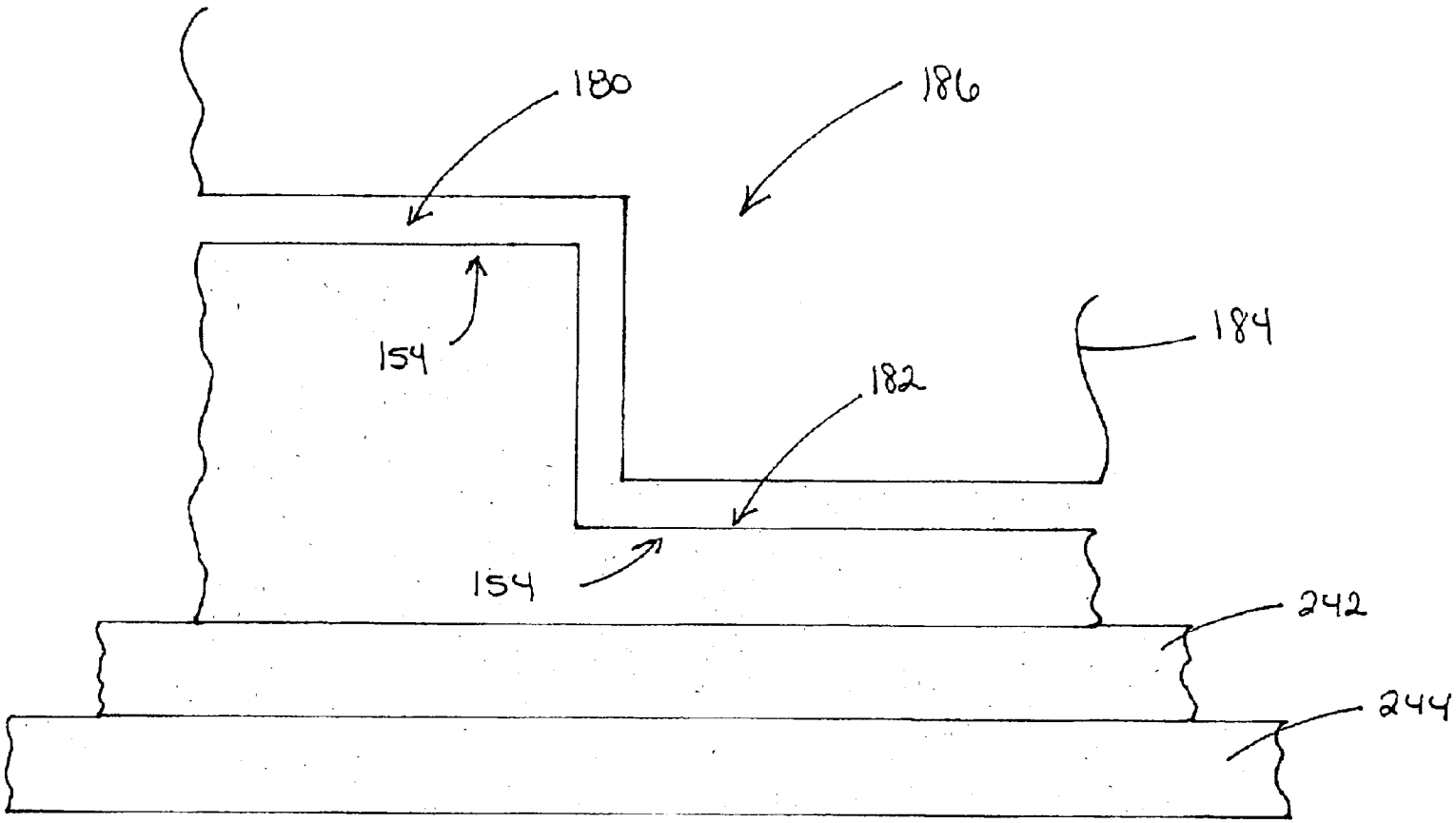
FIG. 11 is a sectional side view of a construction embodying the present invention.

FIG. 11 shows a substrate, generally referred to hereinafter as 184, having an abrupt variation in surface continuity depicted generally as 186. The first height portion 180 and second height portion 182 form a complementary shape to the abrupt variation 186 to allow the membrane 104 to reach a portion of the substrate 184 where an image 102 is to be located. The first height portion 180 may be designed to transfer an image 102 beginning with, or concluding in, for example, a corner or edge 188 of the substrate 184.

The membrane 104 disclosed above may have constant or variable thickness, as will be described in more detail below.

As shown in FIGS. 1 and 2, at least one preconditioning station 190 may be located between the print station 100 and the transfer station 146. Preferably, the preconditioning station 190 conditions the pigment-containing material 114 and/or membrane 104, if required, before the membrane 104 is located in the transfer station 146. Conditioning devices 192 such as, for example, infrared lamps, ultra violet lamps, convection devices and/or humidification devices, as known to those skilled in the art, may be located at the preconditioning station 190.

In one embodiment, a pneumatically driven, controller actuated support table 194 supports the membrane 104 from below during preconditioning steps or post-transfer steps described below.

Figure 12:
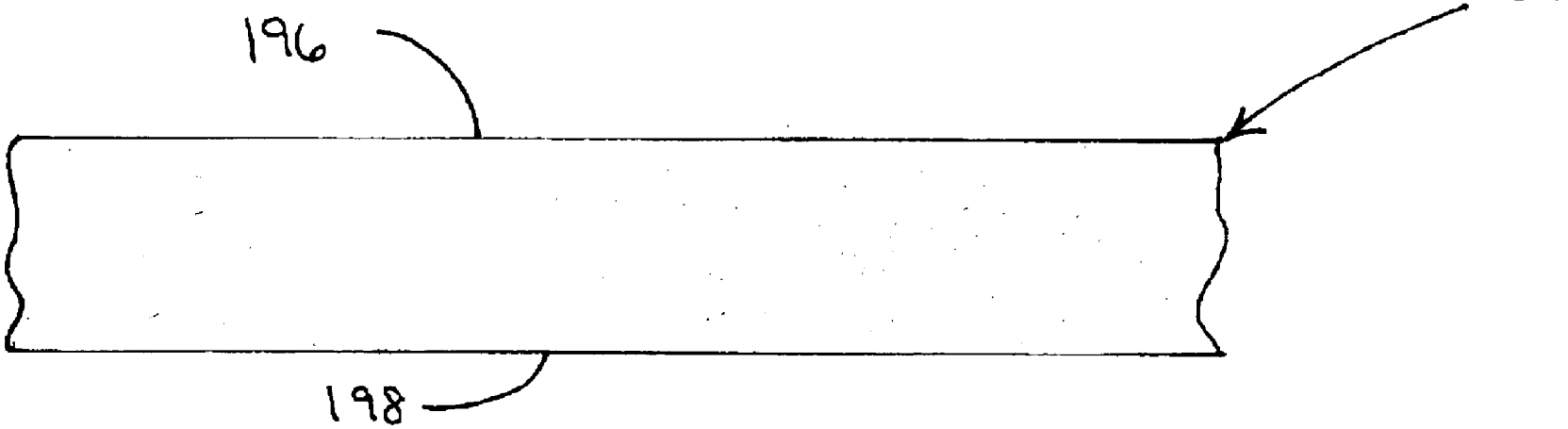
FIG. 12 is a sectional side view of a construction embodying the present invention.
Figure 13:
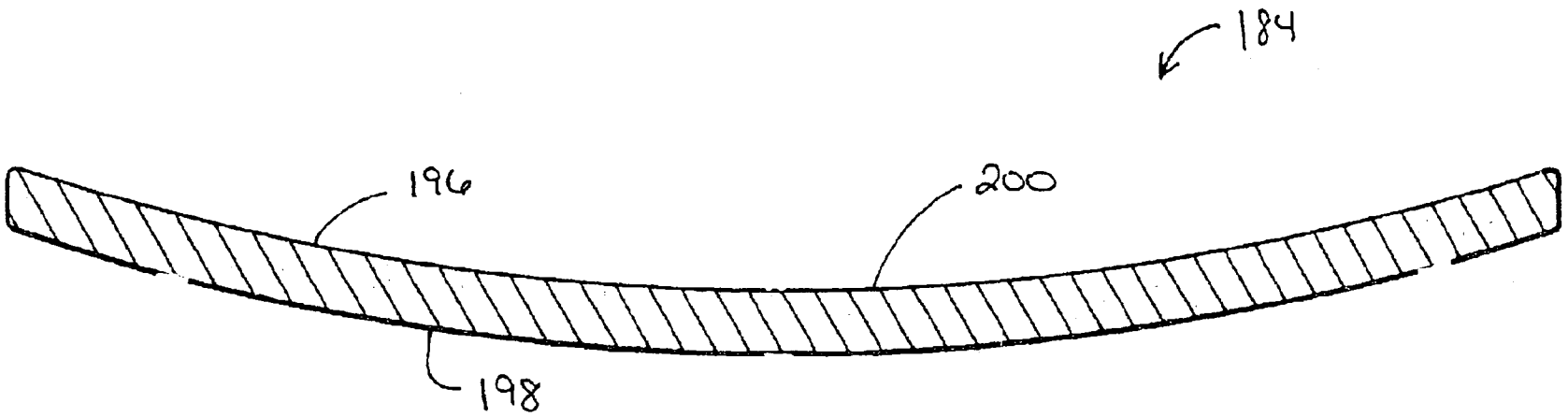
FIG. 13 is a sectional side view of a construction embodying the present invention.
Figure 14:
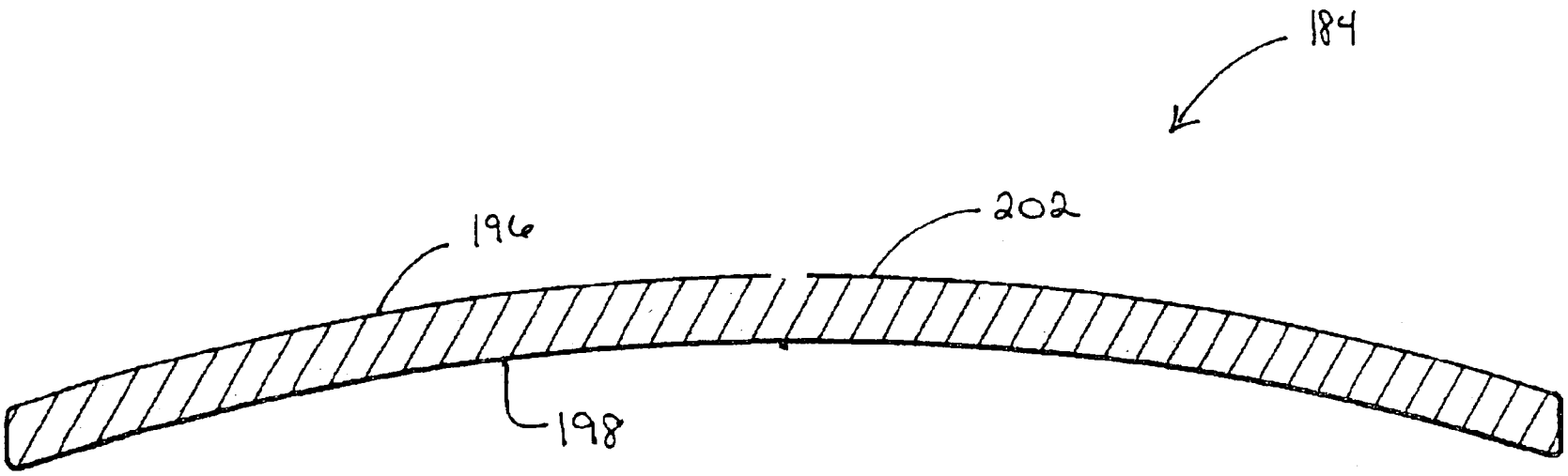
FIG. 14 is a sectional side view of a construction embodying the present invention.
Figure 15:
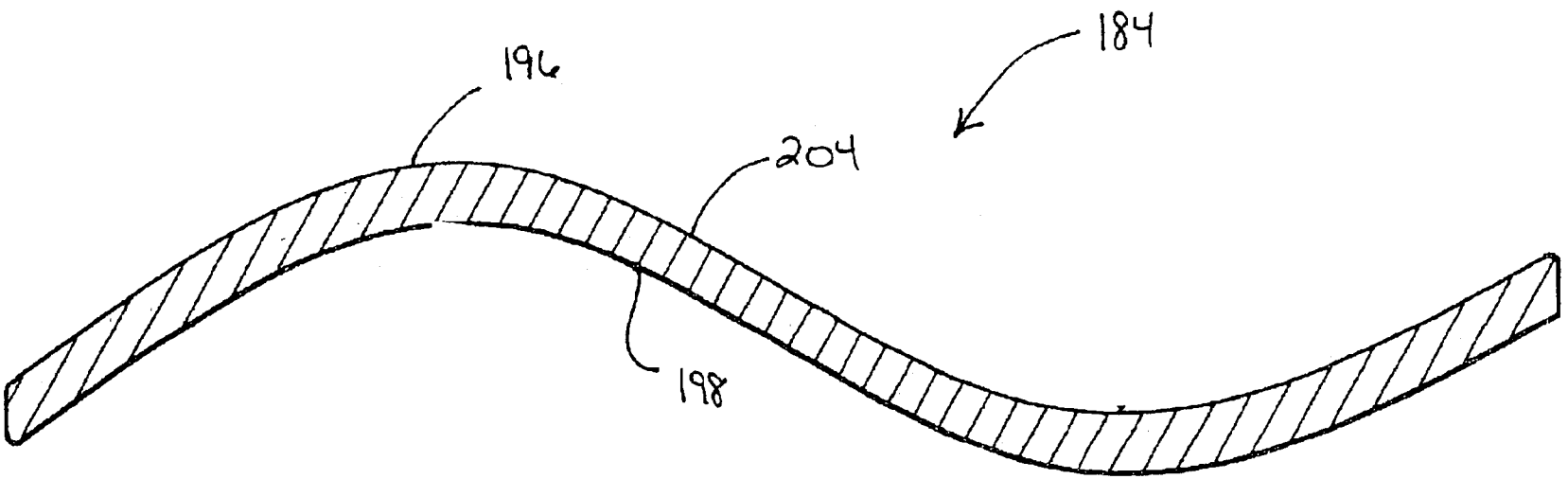
FIG. 15 is a sectional side view of a construction embodying the present invention.

The substrate 184 onto which at least one image 102 is to be transferred is located in the transfer station 146. As depicted in FIG. 12, the substrate 184 may have at least one surface such as, for example, an upper 196 or lower 198 surface at least a portion of which is planar, and/or the substrate 184 may have curved upper 196 and/or lower 198 surfaces having, for example, at least a portion of which are of a concave 200, convex 202 or compound 204 curvature, as depicted in FIGS. 13, 14, and 15, respectively. Compound substrates are constructed, at least partially, by combining one or more concave 200 and convex 202 surfaces. Additionally, the substrate 184 may be constructed having portions of any combination of the above-mentioned surfaces. A method and apparatus for locating an image 102 on the complexly curved inside surface of a concave substrate will be described herein, however, it is well within the scope and spirit of the invention to locate an image 102 on the upper and/or lower surfaces on any of the above-mentioned substrates 184. The substrate 184 may be a plastic material such as, for example, polycarbonate, acrylic, acrylonitrile butadiene styrene, polyamide, or glass, metal, wood, ceramic composites, or other materials.

As shown in FIG. 2, one or more load 205 and/or unload 207 stations are preferably located adjacent the transfer station 146. A manual or automated loading system is used to supply the transfer station 146 with a substrate 184. A manual or automated unload station 207 receives the substrate 184 having an image 102 located thereon and removes it from the present invention and/or transports it to another transfer station 146 to receive additional images 102.

The transfer station 146 preferably has a means to transfer the printed image 102 from at least one membrane 104 to at least one substrate 184. The means to transfer may be, for example, a means for removably securing the substrate 184, a means to shape the membrane 104 into a complementary shape to the substrate 184 and/or a means to urge, or urging means, the membrane 104 into image transferring contact with the substrate 184. Preferably, the means for securing the substrate 184 is a substrate fixture 206 and the means to shape the membrane 104 is a forming fixture 208. Although FIGS. 1 and 2 depict the substrate fixture 206 and the forming fixture 208 in a vertical orientation with respect to one another, such orientation is only one embodiment. The substrate fixture 206 and the forming fixture 208 may be located in any orientation to one another without departing from the scope of the invention.

Figure 16:
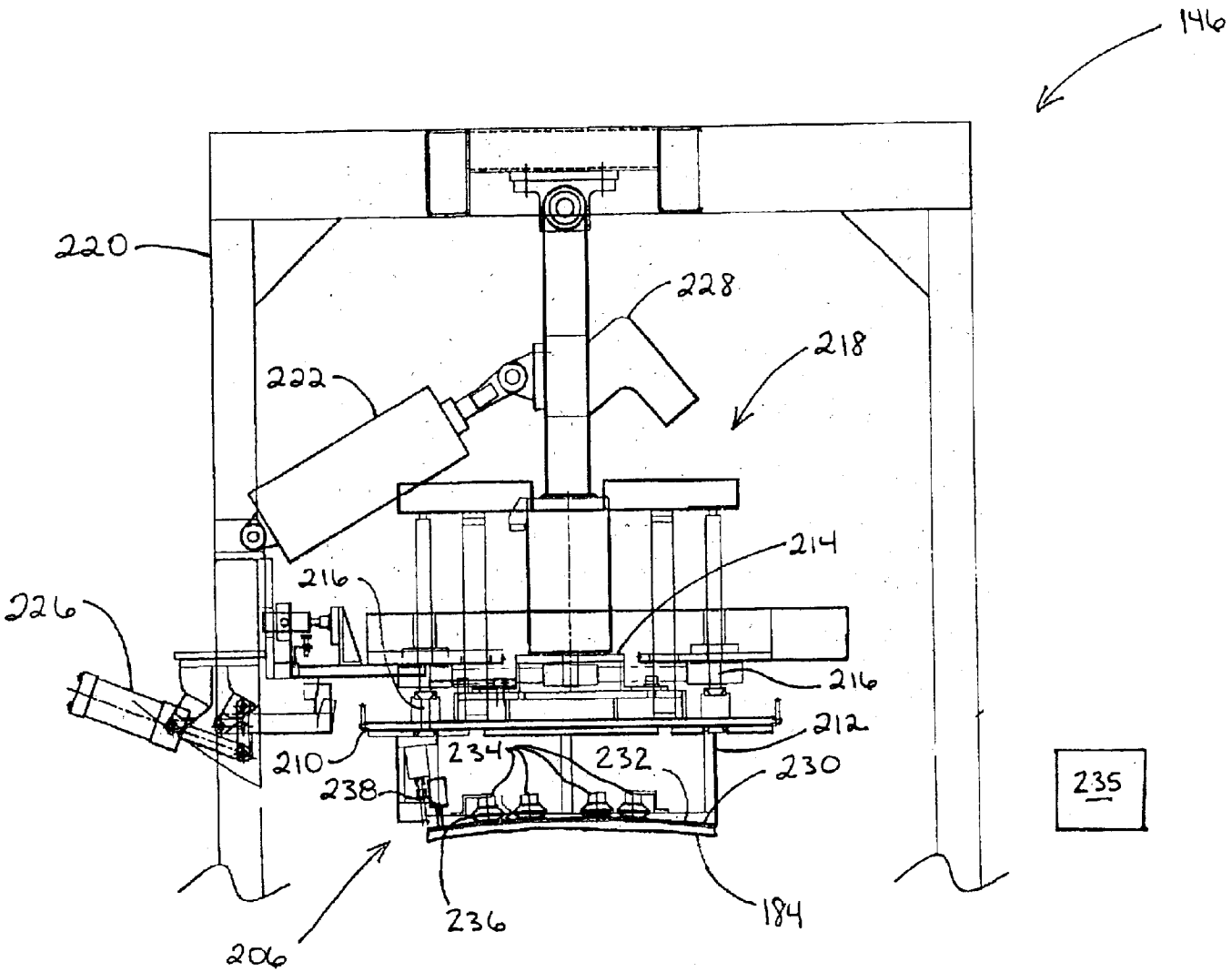
FIG. 16 is a sectional side view of a portion of the construction shown in FIG. 1.

As depicted in FIG. 16, the substrate fixture 206 preferably has a base portion 210 with a raised portion 212 affixed thereto. Preferably, both portions 210, 212 are constructed of an aluminum alloy, although other materials capable of securing the substrate 184 may be used.

The substrate fixture 206 is removably attached to the urging means. A separate substrate fixture 206 is required to be connected to the urging means for each substrate 184 having a particular shape and curvature.

Figure 17:
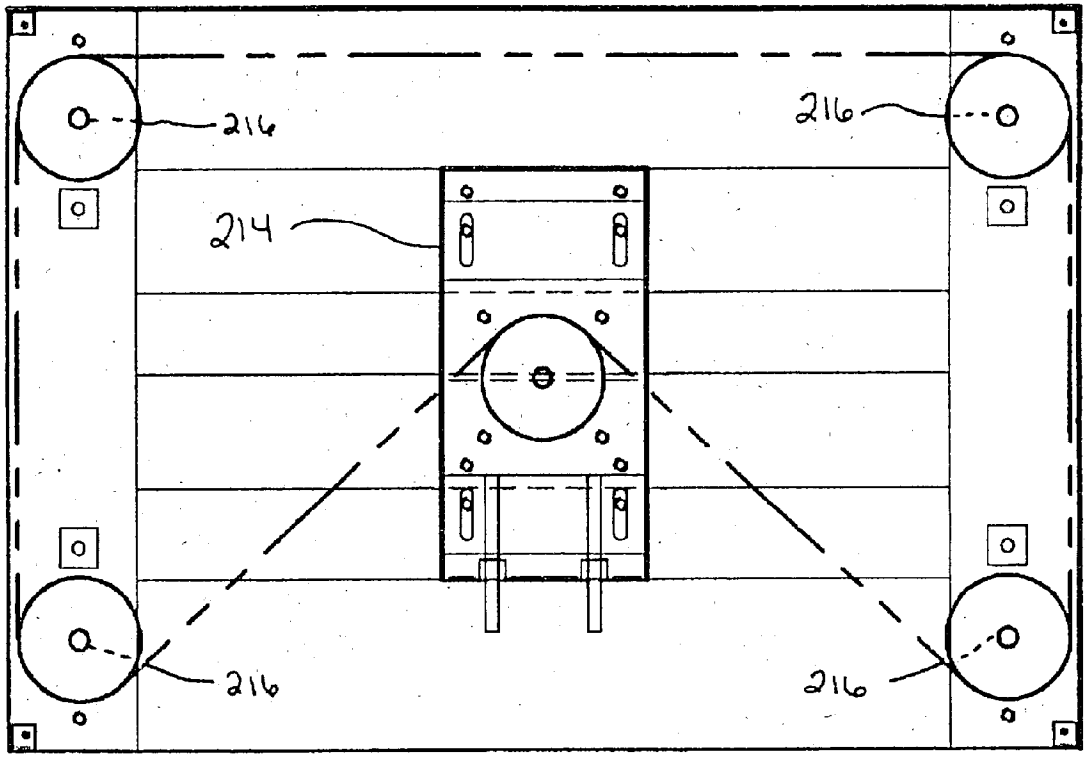
FIG. 17 is a top view of a portion of the construction shown in FIG. 1.

The urging means locates the substrate fixture 206 adjacent the membrane 104. The urging means may include, for example, pneumatic, hydraulic or motor driven means which separately, or in combination, vertically and/or horizontally move the substrate fixture 206. The urging means may be manually or automatically adjustable and reversible to move the substrate fixture 206 away from the membrane 104. In one embodiment depicted in FIG. 17, the urging means is an automatically controlled electric motor 214. The motor 214 is mechanically connected to a plurality of threaded rods 215 threaded into the base 210. Engagement of the motor 214 causes the rods 216 to rotate thereby vertically translating the substrate fixture 206 up or down, a pre-determined distance, depending on the direction of the rotation.

Figure 18:
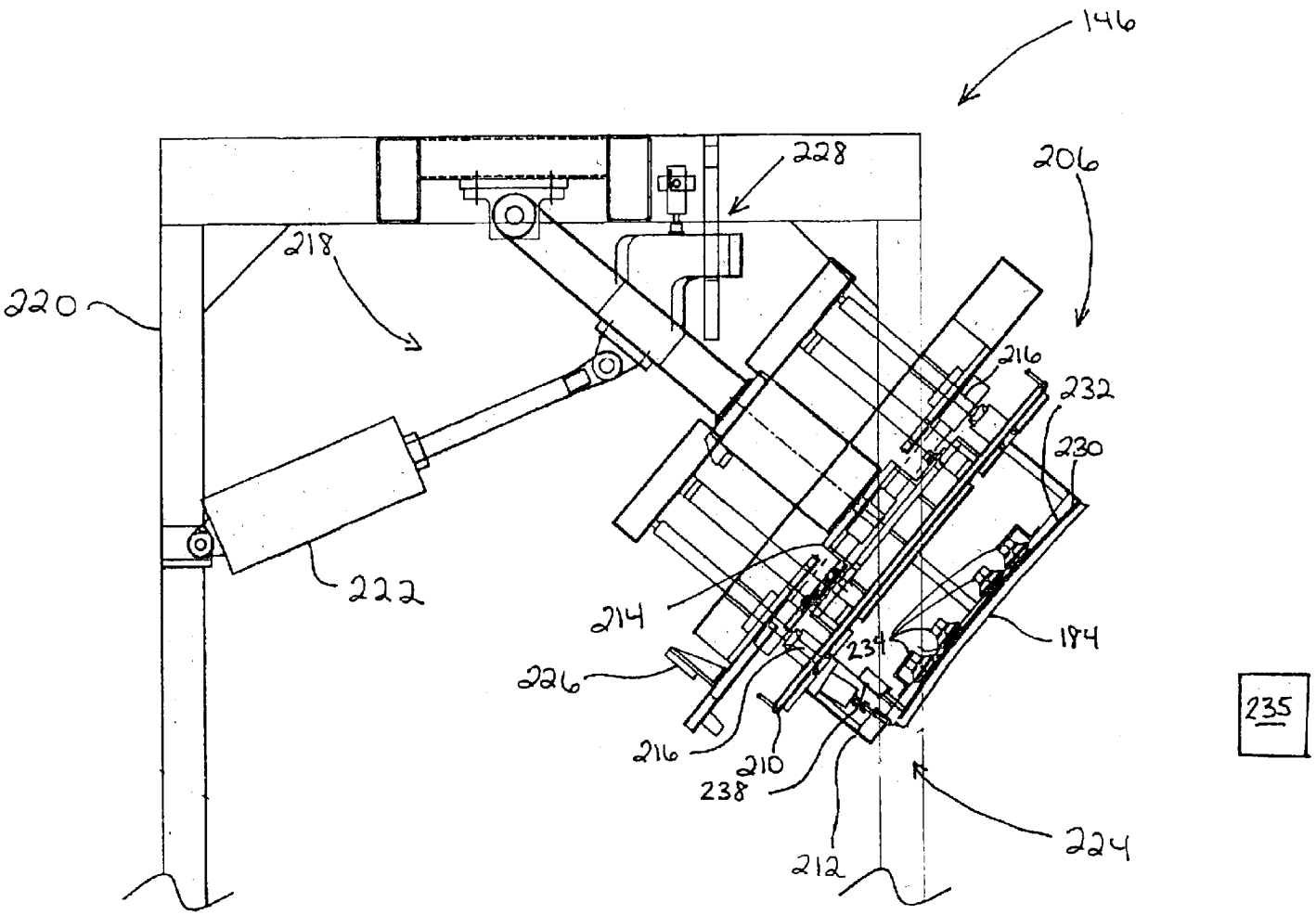
FIG. 18 is a sectional side view of a portion of the construction shown in FIG. 1.

In one embodiment depicted in FIGS. 16 and 18, the urging means includes a pendulum 218 having the substrate fixture 206 attached thereto. The pendulum 218 is pivotally attached to a transfer station frame 220. The pendulum 218 may be moveable manually, hydraulically, with an electric motor means or a combination thereof, however, automatically controlled pneumatic means are preferred. As depicted in FIGS. 16 and 18, at least one pneumatically driven cylinder 222 is attached to the pendulum 218 and the transfer station frame 220. The cylinder 222 moves the pendulum 218 so that the substrate fixture 206 is moveable between an opening 224 in the transfer station frame 220 and a position above the membrane 104 and forming fixture 208. The opening 224 in the frame 220 allows the pendulum 218 to translate the substrate fixture 206 into a substrate loading/unloading position. Preferably, a first locking mechanism 226 located on the frame 220 engages the pendulum 218 and prevents movement during printing. A second locking mechanism 228 on the frame 220 engages the pendulum 218 to prevent its movement during the loading/unloading of a substrate 184.

In a preferred embodiment shown in FIGS. 16 and 18, a sheet 230 of material having a complementary shape to the substrate 184 is located on the surface 232 of the raised portion 212 of the substrate fixture 206. In a more preferred embodiment, the sheet 230 of material is a sheet 230 of plastic such as, for example, urethane as known to those skilled in the art. The surface 232 preferably has means for temporarily and securely locating a substrate 184 against the sheet 230 such as, for example, a plurality of suction-cups 234. The sheet 230 has a plurality of holes 236 so the suction cups 234 can extend through them and contact the substrate 184. The suction cups 234 are connected to at least one selectively engagable vacuum source 235. The vacuum source 235 urges the substrate 184 securely against the suction cups 234 during the transfer process described below. Other means to secure the substrate 184 to the substrate fixture 206 such as mechanical fasteners, friction fittings, clips and clamps may also be used.

The surface 232 also has at least one positioning pin 238 to position the substrate 184 in a precise location on the substrate fixture 206. The at least one pin 238 is capable of being retracted into the substrate fixture 206 after the vacuum source 236 is engaged so as not to interfere with the transfer step described below. Locating the substrate 184 in a precise location on the substrate fixture 206 aligns it with the membrane 184 and forming fixture 208 for a precise transfer of the image 102.

Figure 19:
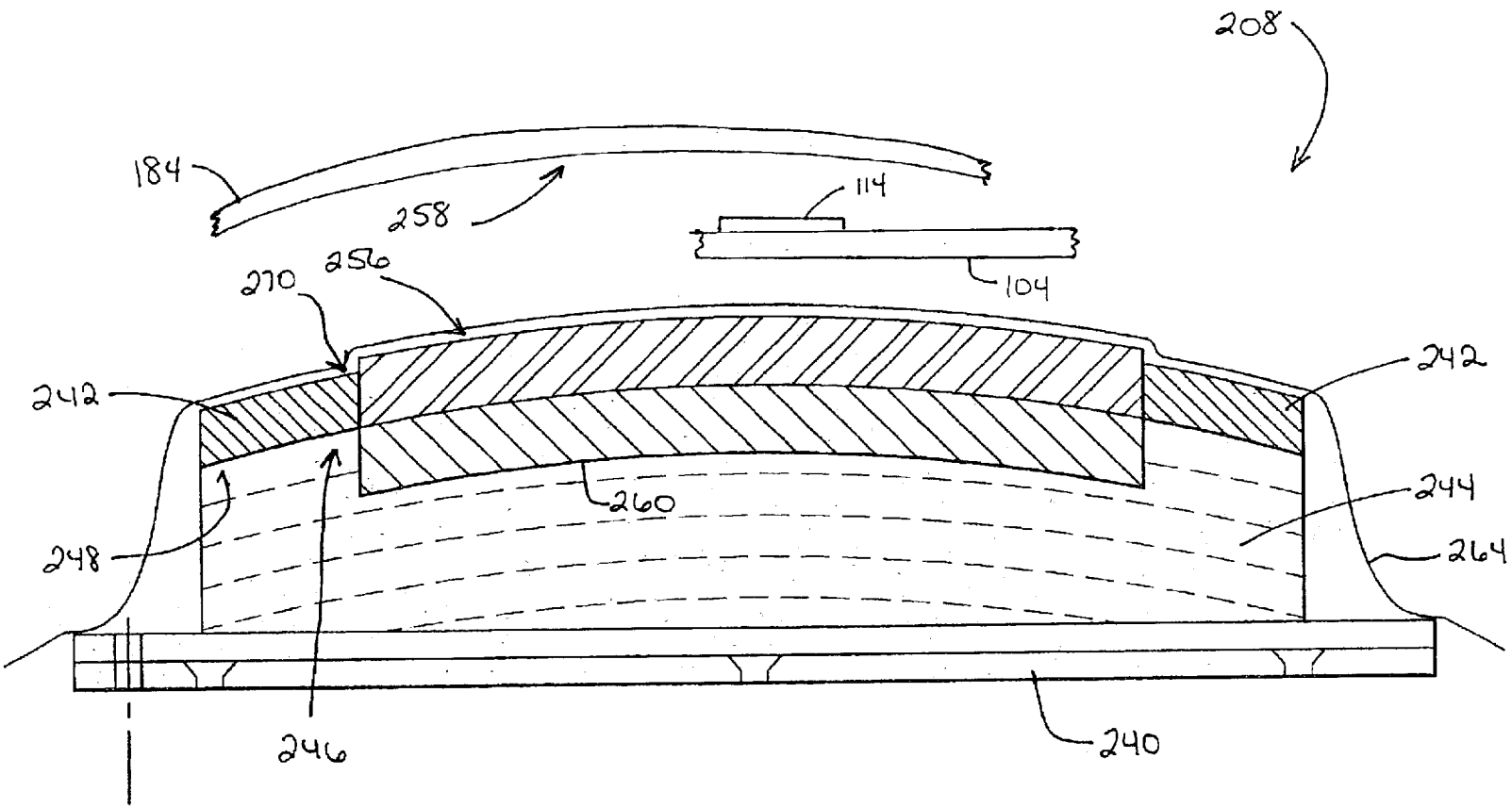
FIG. 19 is a side view of a construction embodying the present invention.

As shown in FIG. 19, the forming fixture 208 preferably has at least a base portion 240 and a conformable material 242 capable of substantially conforming to the surface of the substrate 184 on which an image 102 will be located. Preferably the forming fixture 208 also has a shapable material 244 shaped into a complementary shape to the substrate 184. The shapable material 244 is removably attached to the base portion 240 to allow other shapable materials 244 conforming to various substrate surfaces to be used. The shapable material 244 may be such as, for example, a foam urethane, although other similar materials known to those skilled in the art may be used.

In one embodiment, the shapable material 244 has a first height portion 246 and at least a second height portion 248. The first height portion 246 has a greater height than the second height portion 248. The first height portion 246 may be located radially inward or radially outward from the second height portion 248. In another embodiment depicted in FIG. 20, the shapable material 244 has a constant thickness.

The shapable material 244 supports the conformable material 242. The conformable material 242 is shaped substantially into a complementary shape to the substrate 184 and according to the image 102 to be transferred. In the embodiment where the shapable material 244 has a first height portion 246 and at least a second height portion 248 depicted in FIG. 19, the conformable material 242 preferably has a constant thickness. In the embodiment where the shapable material 244 has a constant thickness depicted in FIG. 20, the conformable material 242 has a first portion 250 having a first height and at least a second portion 252 having a second height. The first height has a greater height than the second height and may be located radially inward or outward from the second height.

Figure 21:
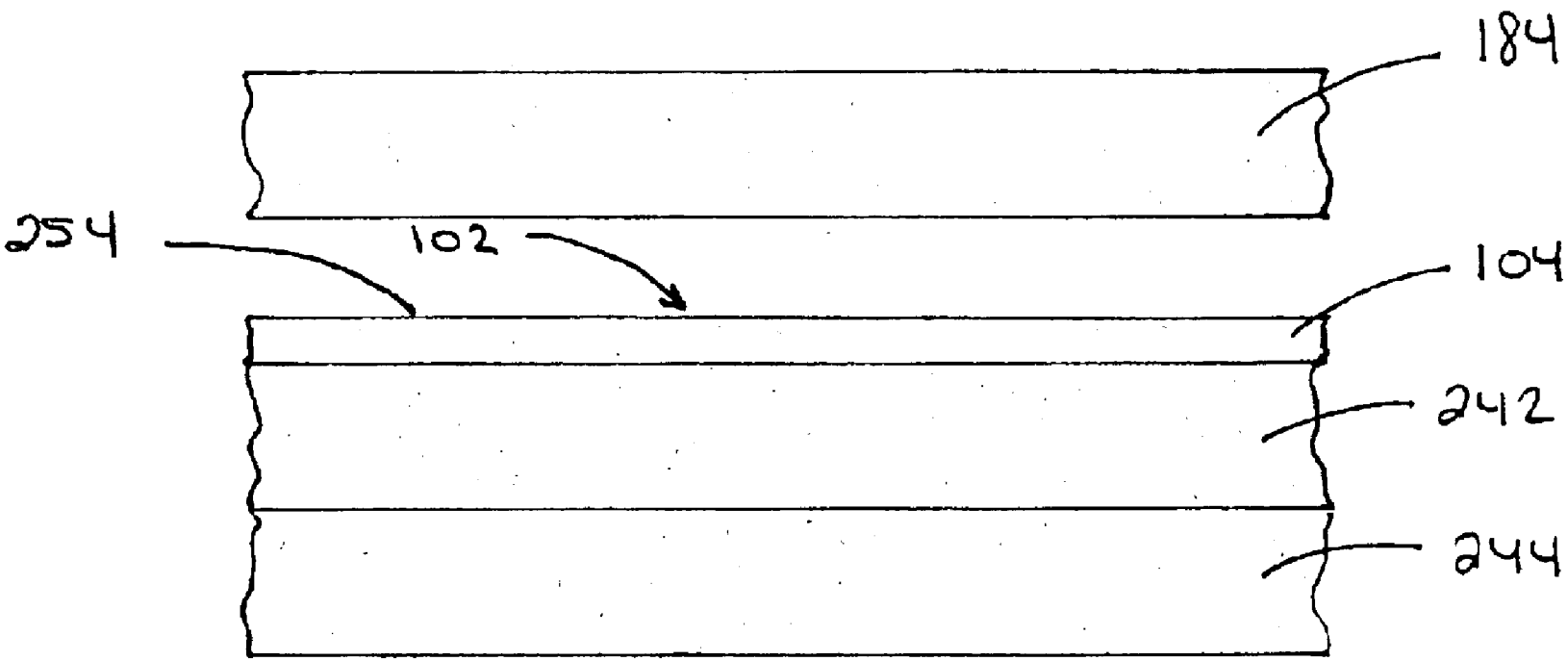
FIG. 21 is a side view of a construction embodying the present invention.

In yet another embodiment depicted in FIG. 21, the conformable material 242 and the shapable material 244, if any, may have a substantially horizontal upper surface 254.

In one embodiment depicted in FIG. 19 in which a band of pigment-containing material 114 is to be transferred on the substrate 184, at least one interior portion 256, constructed from a rubber or silicone compound in a complementary shape to an interior portion 258 of the substrate 184, is located in a hollowed-out interior portion 260 of the conformable 242 and shapable materials 244. The at least one interior portion 256 is designed to reduce, or prevent, movement of the conformable material 242 and urge the membrane 104 into a substantially wrinkle-free complementary shape to the substrate 184 during the transfer step described below.

Figure 22:
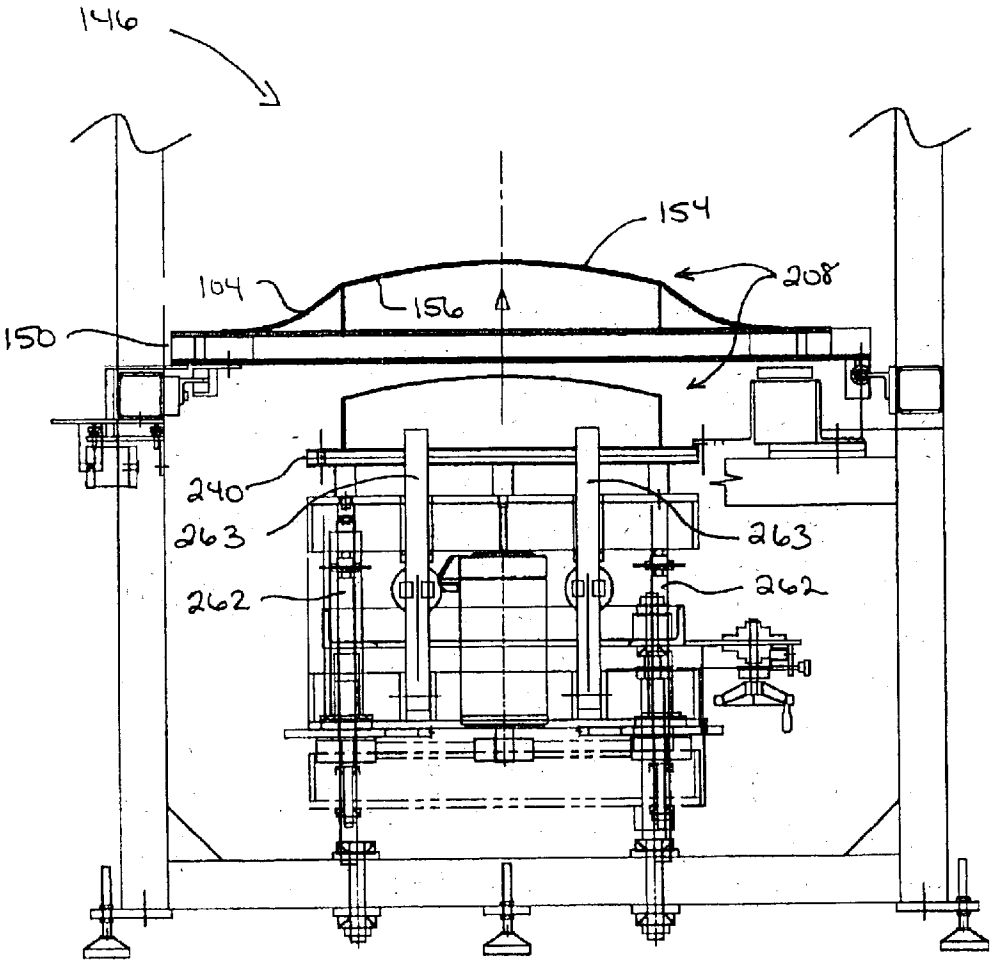
FIG. 22 is a sectional side view of a portion of the construction shown in FIG. 1.

The base portion 240 is preferably connected to a source of vertical motion, such as, for example, hydraulic, pneumatic or motor means. The source of vertical motion may be driven either manually or by controller actuated means. Preferably, the source of vertical motion is at least one pneumatic cylinder 262 controlled by controller 124 actuated means, as depicted in FIG. 22. The pneumatic cylinder 262 vertically translates the base portion 240 a predetermined distance to locate the forming fixture 208 adjacent the membrane 104.

At least one lock means is selectively attached to the transfer station frame 220 to engage the base 240 to prevent, or reduce, movement during the transfer step described below. Preferably, the lock means is a clamp 263 secured to each corner of the base 240. The clamp 263 may engage the base 240 manually, hydraulically, with an electric motor, or a combination thereof, however, automatically controlled, pneumatically-driven cylinders are preferred.

As shown in FIG. 19, at least one sheet of barrier material 264 may be optionally located over the forming fixture 208 and preferably over the conformable material 242. The barrier material 264 is designed to prevent, or reduce, the possibility of contamination of the forming fixture 208 with dust or the like and prevent any undesirable interactions between the forming fixture 208 and the membrane 104.

In one embodiment, the pre-conditioning station 190 depicted in FIGS. 1 and 2 can also act as a post-transfer station 266 if such a station is desired. Alternatively, at least one post-transfer station 266 may be located separately from the pre-conditioning station 190. The post-transfer station 266 has one or more manual or automated means for removing residues, such as pigment-containing material 114 and/or solvents, from the membrane 104. The post-transfer station 266 may also have automated or manual inspection means to inspect the membrane 104 after the transfer step described below.

If the substrate 184 will receive a second transferred image, then it is preferred that the first transferred image be cured by one or more curing devices 268 before the second image is transferred. The curing devices 268 may be, for example, one or more infrared lamps, ultra violet lamps and/or convection-type devices or other pigment-containing material curing devices known in the art. The curing devices 268 may be located at a curing station 269.

The apparatus, as depicted in FIGS. 1 and 2, is preferably located in a clean room (not shown), such as those known in the art, to reduce or eliminate contaminates which may interfere with, or otherwise adversely effect, the printing and transfer processes described below.

In an alternative embodiment (not shown) to the above-described print and transfer process utilizing a membrane, an image is transferred to a curved substrate, such as a complexly curved inside surface of a substrate using a squeegee, as known to those skilled in the art, and a vacuum source. In this embodiment, a substrate to have an image transferred thereon is located on a substrate support structure. In one embodiment of the substrate support structure, the substrate support structure has a removable plate.

The substrate is secured to the substrate fixture with the removable plate having an inside and an outside surface. The outside surface of the removable plate has a recessed portion having substantially the same curvature and dimensions as the substrate to be printed. Removable plates for substrates having different curvatures and dimensions may be interchangeably located within the substrate fixture. The removable plate is mechanically connected to the substrate fixture, preferably with a plurality of screws, however, other mechanical fasteners known in the art are well within the scope of the invention. The inside surface of the removable plate is supported by manually or mechanically adjustable support means. The adjustable support means adjust to the curvature and shape of the particular removable plate located on the substrate fixture for a particular substrate.

The substrate is removably secured to the outside surface of the removable plate by clamps, screws, male-female couplings or any similar mechanical attachment device. In a preferred embodiment, the substrate is secured to the outside surface by a vacuum source. The vacuum source may be the same source used to secure the membrane to the print table or it may be a second, separate source. The recessed portion of the removable plate has a plurality of ports in communication with the vacuum source. The ports communicate the suction force of the vacuum to the substrate and securely locate the substrate to the substrate fixture. Means to interrupt the communication of the vacuum source with the ports, such as those disclosed above, may be utilized to allow for the removal of the substrate from the substrate fixture.

The substrate support structure may be manually or mechanically adjustable to conform to the curvature and dimensions of a particular removable plate.

Preferably, a first set of vacuum ports is located in a recessed portion of the removable plate. The first set of vacuum ports is in communication with the vacuum source. The substrate is located within the recessed portion and the vacuum source is engaged. The force of the vacuum is communicated through the first set of vacuum ports and acts upon the substrate thereby securely fixing the substrate to the removable plate.

A membrane having an image located thereon, is located substantially horizontally above the substrate and pigment-containing material is located thereon, as described above. The membrane is capable of flexibly conforming to the inside surface of a complexly curved substrate. Manual or mechanical means are used to contact the first portion of the flat membrane and deflect it so that it contacts substantially the first inside portion of the substrate. Manual or mechanical means may also be used to deflect a second portion of the membrane so that it contacts a second inside portion of the substrate. A second set of vacuum ports located on the perimeter of the recessed portion is connected to the same vacuum source connected to the first set of ports or it may be connected to a separate vacuum source. The vacuum from the second set of ports securely locates substantially the entire membrane onto the substrate.

A squeegee, such as those known in the art, capable of fitting between the above-described manual or mechanical deflection means, is brought into contact with the upper surface of the membrane adjacent the image to be transferred. The squeegee is translated across the pattern thereby transferring the image on the substrate. The squeegee is then removed from the surface of the membrane.

Alternatively, the squeegee may be an air knife, or a squeegee which utilizes pressurized air to force the membrane into image transferring contact with the substrate, similar to air knives known to those skilled in the art. The air knife is in communication with a pressurized air source. The air knife is either manually or mechanically located adjacent the upper surface of the membrane and the air source is engaged. The air knife directs pressurized air against the upper surface of the membrane in an amount sufficient to compress the membrane onto the substrate thereby effecting printing.

In yet another alternative embodiment, the squeegee may be other compression means known to those skilled in the art such as a pad, air pressure or a vacuum.

The vacuum source connected to the second set of ports is disengaged and the manual or mechanical means locating the second portion of the membrane against the second portion of the substrate is removed. The tension in the membrane urges the membrane away from the second portion of the substrate in a direction toward the first portion of the substrate. The manual or mechanical means used to deform the first portion of the membrane are removed from the membrane and the tension in the membrane returns the membrane to its original horizontal position. The first set of vacuum ports securing the substrate within the recessed portion is disengaged from the vacuum source and the substrate having the image located thereon is removed from the substrate support structure.

In yet another alternative embodiment, a mesh may be located above a membrane having an image located thereon. Pigment-containing material is distributed on the upper surface of the membrane, as described above. An upper surface of the mesh is attached to an airtight flexible barrier. The barrier is capable of flexibly conforming to the surface of a complexly curved substrate. The flexible barrier has a first portion and a second portion. A substrate having a complexly curved inside surface is located within a substrate support structure substantially as described above. The substrate is located adjacent the membrane.

Manual or mechanical means, as described above, may be used to downwardly deflect a first portion of the barrier, which contacts the first portion of the membrane and which then contacts a first inside portion of the substrate. Manual or mechanical means, as described above, are also used to downwardly deflect the second portion of the barrier, which in turn contacts the second portion of the membrane and which in turn contacts a second inside portion of the substrate.

The vacuum source in communication with the second set of vacuum ports is engaged. One or more breaks in the membrane allow the vacuum to be communicated through the membrane and into the mesh above. The mesh allows the vacuum force to be evenly distributed across the barrier thereby uniformly urging the barrier against the membrane. The membrane is thereby urged against the substrate which in turn transfers the image on the substrate.

If desired, pressure may be applied by manual or mechanical means, such as by the squeegee or air knife described above, or by air pressure, vacuum, pads, or any other means known to those skilled in the art, to an upper surface of the barrier. The pressure facilitates in an interface between the substrate and the membrane to complete the transfer step.

The vacuum is disengaged from the second vacuum ports and the manual or mechanical means used to downwardly deflect the second portions of the barrier and membrane are removed. The tension in the membrane urges the perimeter portions to rebound away from the substrate. The manual or mechanical means in contact with the first portion of the barrier are also removed thereby allowing the first portions of the membrane and barrier to be urged away from the substrate. The vacuum is disengaged from the first vacuum ports and the substrate having an image located thereon is then removed from the apparatus.

The process of printing on a substrate 184 using the present invention is described hereinafter. As seen, for example, in FIGS. 16 and 18, the urging means, having a substrate fixture 206 attached thereto has a substrate 184 located thereon. In the embodiment where the urging means is connected to a pendulum 218, the pendulum 218 is translated toward the opening 224 in the transfer station frame 220 by the controller 124 controlling the at least one pneumatic cylinder 222 connected to the frame 220 and the pendulum 218. A substrate 184 is located on the at least one positioning pin 238 by mechanical or manual means. The vacuum source 235 connected to the suction cups 234 on the surface 232 of the raised portion 212 is engaged thereby urging the substrate 184 securely to the substrate fixture 206. The at least one positioning pin 238 retracts into the raised portion 212 of the substrate fixture 206 either automatically or through manual means. The at least one pneumatic cylinder 222 then rotates the pendulum 218 so that the substrate fixture 206 is in a position substantially parallel with the forming fixture 208 below.

A membrane 104 is securely located in the frame 150 in a substantially flat orientation. In one embodiment, the individually controlled, pneumatic cylinders are individually engaged to create a pre-determined amount of tension in the membrane 104 or portions of the membrane 104. In another embodiment of the invention depicted in FIGS. 4 and 5, the controller 124 engages the tensioning system, such as, for example, the pneumatic cylinders mechanically connected to the rack and pinion system 170, to locate a predetermined amount of tension in the membrane 104. The amount of tension applied insures that the membrane 104 remains in a flat condition during screen printing. The controller 124 controls the source of motion connected to the frame 150 and the frame 150 and the membrane 104 are then transported along the track 148 to the print station 100.

In the embodiment using screen printing, a membrane 104 having an image 102 thereon is located in a membrane frame 150 and both are located in a printing machine as described above and shown in FIGS. 1 and 2. The frame 150 and flat membrane 104 are located precisely under the screen 116 so that the image 102 is directly over the desired portion of the membrane 104. The support table 122 translates vertically until it is adjacent the lower surface 156 of the membrane 104. The source of vacuum 130 is engaged and the membrane 104 is secured to the upper surface 138 of the table 134 to reduce, or prevent, the flat membrane 104 from flexing away from the table 134 during the printing step. The screen 116 is moved adjacent the flat membrane 104 with either automated or manual means. Pigment-containing material 114 is located on the screen 116. The flood bar translates across the screen 116 evenly distributing the pigment-containing material 114 across the screen. The squeegee then translates across the screen 116 urging the pigment-containing material 114 through selected parts of the screen 116 thereby printing a precise image 102 on the membrane 104 below.

Figure 3:
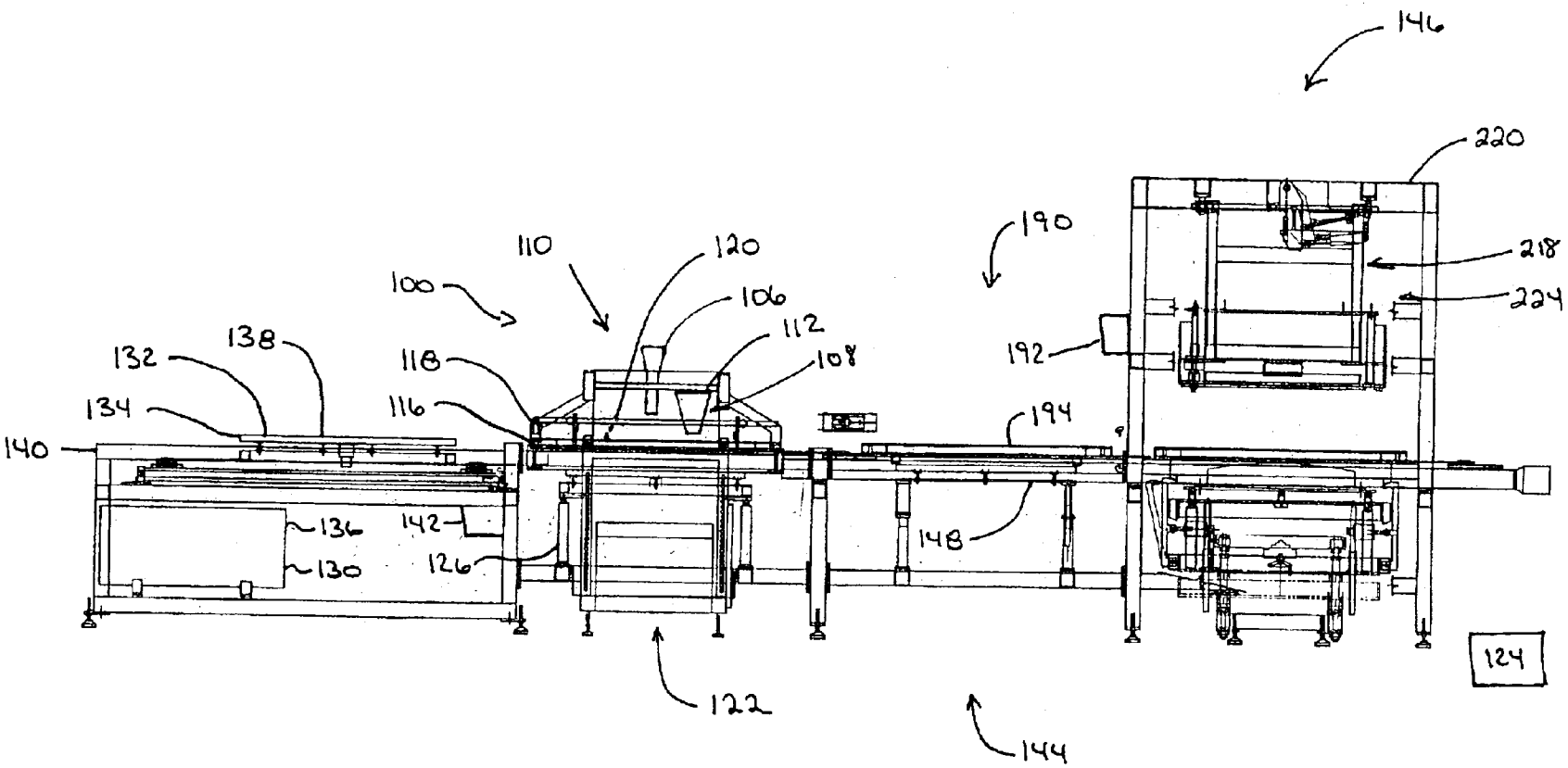
FIG. 3 is a side view of another embodiment of the invention of FIG. 1.

In another membrane 104 printing embodiment shown in FIG. 3, a print head 106, such as, for example, a thermal bubble type or a piezoelectric type as known in the art, is located adjacent the upper surface 154 of the membrane 104. A print head stepper motor uses a belt to move the print head 106 across the membrane 104. The motor locates the print head 106 where printing is desired allowing the print head 106 to spray pigment-containing material 114 on the membrane 104 thus creating an image 102 on the flat membrane 104.

In any embodiment, a sufficient quantity and quality of pigment-containing material 114 is provided from the screen 116 to the membrane 104 for subsequent transfer of the pigment-containing material 114 from the membrane 104 to the substrate 184.

In yet another embodiment, the membrane 104 is screen printed and also printed with the print head 106. Either printing process may occur first to print a portion or all of the membrane 104 and then the second process may be used to print on a portion or all of the membrane 104.

When the image 102 has been printed on the membrane 104, the controller 124 signals the source of vacuum 136 to disengage and for the support table 134 to lower. The source of motion connected to the frame 150 is energized and the frame 150 moves from the print station 100 to either the preconditioning station 190 or directly to the transfer station 146. At the preconditioning station 190 shown in FIGS. 1 and 2, the printed membrane 104 may be manually or automatically inspected before being sent into the transfer station 146. In one embodiment, one or more of the conditioning devices 192 discussed supra are engaged. Additionally, excess pigment-containing material 114 deposited on the membrane 104 from the printing step may be removed at the preconditioning station 190.

The print station 100 can print on the medium 132, or paper, any time when the frame 150 and membrane 104 are not located therein. In one embodiment depicted in FIGS. 1 and 2, the controller 124 moves the vacuum table 134 into the print station 100 after a pre-determined time has passed since the last time the print station 100 printed. Preferably, a clean sheet of medium 132 has been pre-located on the vacuum table 134 either by manual or automated means. The source of vacuum 136 is engaged and the table 134 and the medium 132 are located in the print station 100. The print station 100 functions as described above to print on the medium 132.

In the alternative embodiment, when the pre-determined time has passed since the last time the print station printed, the take-up spool draws medium from the supply spool into the print station. The print station functions as described above to print on the medium.

Both of the above-described embodiments allow the pigment-containing material 114 to remain in a print-ready condition regardless of the length of time that has passed since the membrane 104 was printed. In an alternative embodiment, the controller 124 may be overridden and an operator may manually or automatically send the vacuum table 134 and the medium 132 into the print station 100, or the operator may advance the take-up spool, and trigger the print step.

At the transfer station 146, the controller 124 disengages the motor when the frame 150 and membrane 104 are in a pre-determined location in the transfer station 146. The pre-determined location is substantially between the substrate fixture 206 above and the forming fixture 208 below.

The tensioning system relaxes the membrane 104 so that it will adequately conform to the forming fixture 208. The controller 124 preferably energizes the vertically translatable means of the forming fixture 208. The forming fixture 208 translates vertically until the conformable material 242 is substantially adjacent the lower surface 156 of the membrane 104. If desired, the forming fixture 208 can be located adjacent the membrane 104 to create a pre-determined amount of tension in the membrane 104. The membrane 104 has substantially conformed to the shape of the forming fixture 208 to render the membrane 104 substantially wrinkle-free. Thus, the forming fixture 208 and membrane 104 have assumed a complementary shape to the surface of the substrate 184.

The controller 124 actuates the electric motor connected to the substrate fixture 206 bringing the substrate 184 into image transferring contact with the formed membrane. In one embodiment depicted in FIG. 19, the shapable material 244 has a first height portion 246 and at least a second height portion 248 and the conformable material 242 has a substantially constant thickness located thereon. The conformable material 242 conforms to the shape of the shapable material 244. For example, the first height portion 246 of the shapable material 244 urges upwardly a first portion 270 of the conformable material 242 located adjacent the first height portion 246. The first 246 and second height 248 portions may be highly localized portions of the shapable material 244 or they may be general areas of the shapable material 244.

Figure 23:
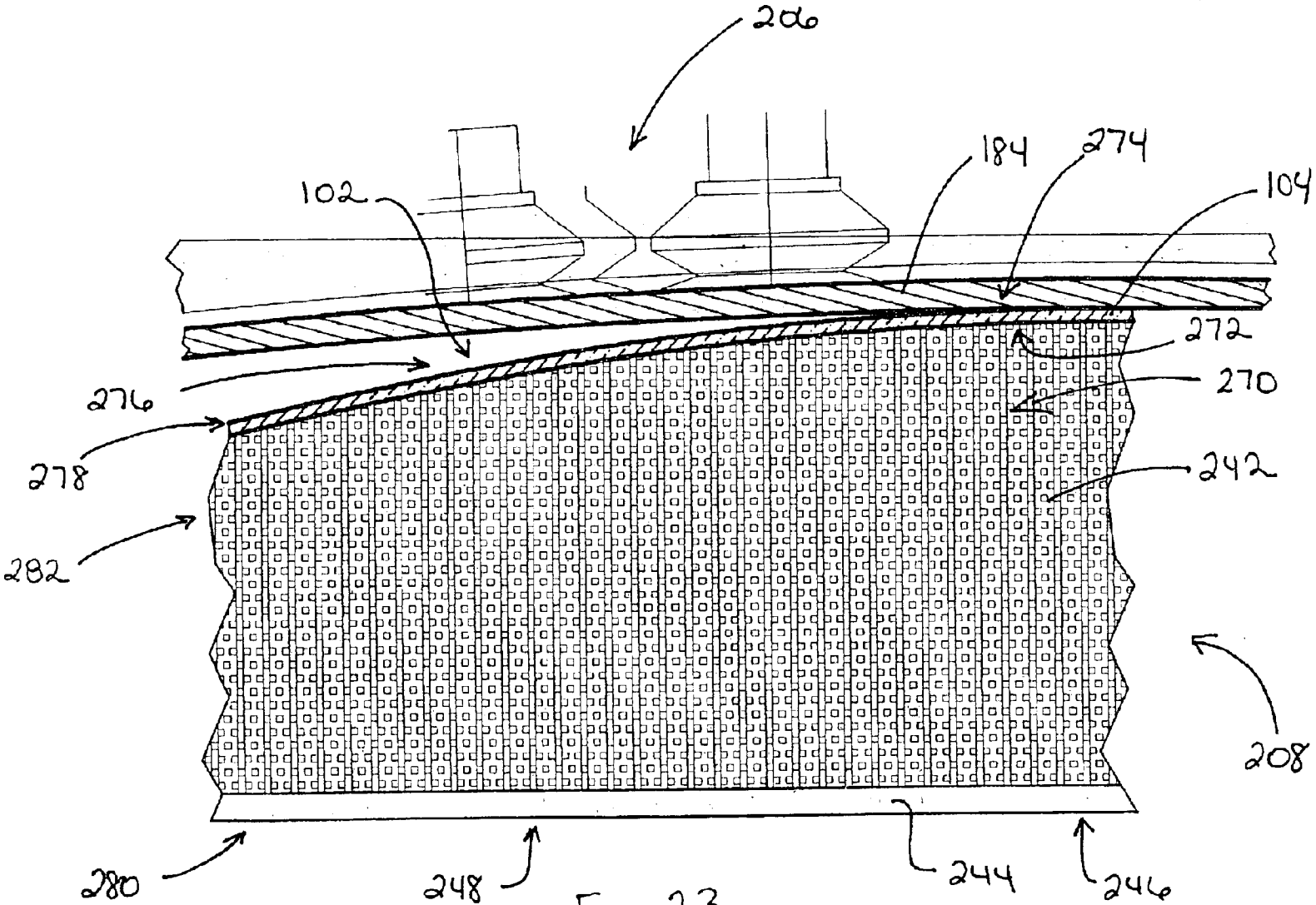
FIG. 23 is a sectional side view of a construction embodying the present invention.
Figure 24:
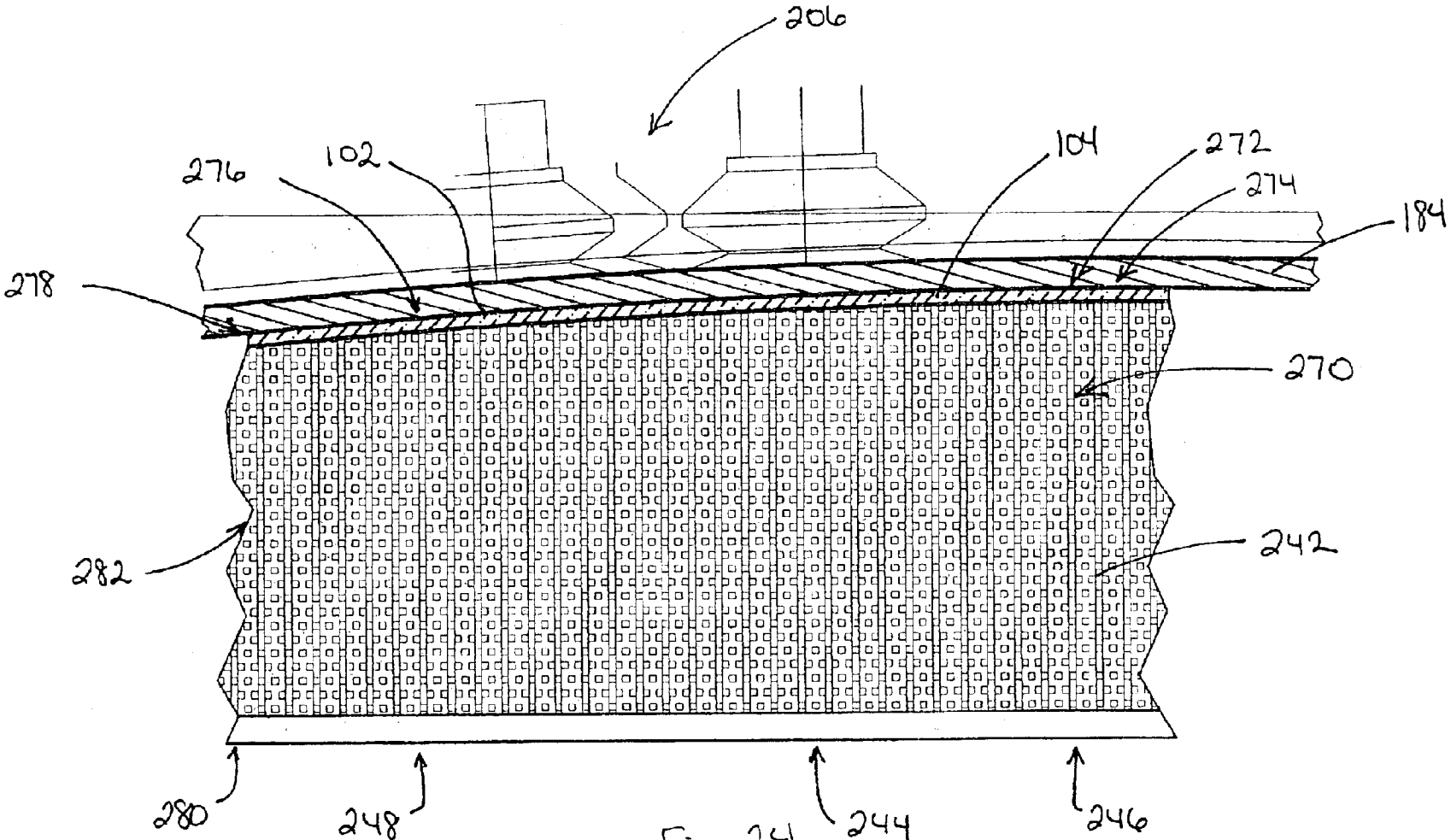
FIG. 24 is a sectional side view of a construction embodying the present invention.

The first portion 270 of the conformable material 242 urges upwardly a first portion 272 of the flexible membrane 104 located thereon. As shown in FIG. 23, the first portion 272 of the flexible membrane 104 having at least a portion of the image 102 printed thereon simultaneously contacts and conforms to a first portion 274 of the substrate 184 when the substrate fixture 206 compresses the substrate 184 into the membrane 104. The image on the first portion 272 of the membrane 104 transfers to the substrate 184. As pressure is added, the first portion 272 of the membrane 104 and the first portion 270 of the conformable material 242 begin to compress. As the first portion 270 compresses, a second portion 276 of the membrane 104, if any, is urged into image transferring contact with the substrate 184 in a manner substantially identical to the first portion 272 of the membrane 104 as depicted in FIG. 24. As pressure is added, successive portions 278 of the membrane 104 are then urged into image transferring contact by successive portions 280 of the shapable material 244 and sucessive portions 282 of the conformable material 242 in a manner substantially identical to the first portion 272 of the membrane 104 with the substrate 184 until the entire image 102 is transferred thereto. The successive portions 280, 282 of the conformable 242 and shapable 244 materials may be located radially inward and/or radially outward from the first and second height portions 246, 248.

The first height portion 246 of the shapeable material 244 need not necessarily initially urge a portion of the membrane 104 into first image transferring contact with the substrate 184. The various height portions of the shapeable material 244 may be designed to urge any portion of the membrane 104 into image transferring contact in any order, orientation and/or location on the substrate 184.

Figure 20:
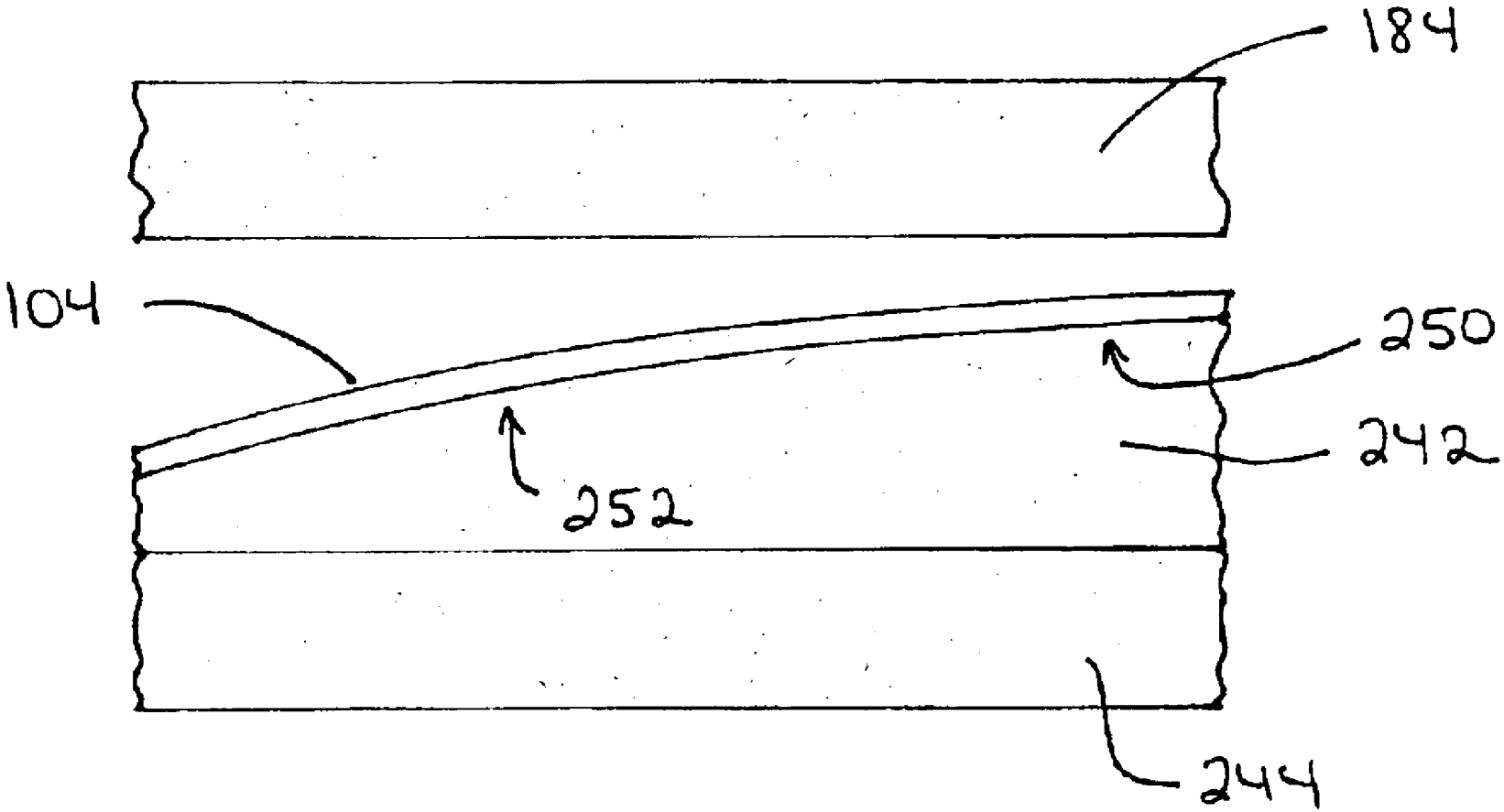
FIG. 20 is a side view of a construction embodying the present invention.

In another embodiment depicted in FIG. 20, the shapable material 244 has a substantially constant thickness and the conformable material 242 has a first height portion 250 and at least a second height portion 252. The membrane 104 located over the conformable material 242 is urged upwardly by the first height portion 250 to contact and conform to the substrate 184 substantially as disclosed above. The second height portion 252, in addition to any successive height portions, urge respective portions of the membrane 104 into conforming contact with respective portions of the substrate 184 in a manner substantially as disclosed above.

In the embodiment wherein a shaped membrane 104 is used as depicted in FIG. 11, the conformable material 242 and the shapeable material 244 are preferably of constant thicknesses, although it is within the scope of this invention to vary their thicknesses as provided above to optimally transfer an image 102. The shaped membrane 104 is located adjacent the conformable material 242 on the substrate fixture 206 for support and to conform the membrane 104 to the substrate 184, if required. The substrate fixture/membrane combination is urged into image transferring contact with the substrate 184 such that a first height portion 180 of the shaped membrane 104 contacts a first portion 284 of the substrate 184 to transfer at least a first portion of an image 102. As pressure is added, the first height portion 180 compresses and conforms to the first portion 284 of the substrate 184. The second height portion 182, if any, is located in image transferring contact with the substrate 184. Successive portions of the membrane 104, if any, are located in image transferring contact, substantially as described above, until the entire image 102 on the membrane 104 is transferred to the substrate 184. The successive portions of the membrane 104 may be located radially inward and/or radially outward from the first 180 and the second 182 portions of the membrane 104.

In another embodiment shown in FIG. 21, wherein the substrate 184 is flat or curved, the shapeable 244 material, the conformable material 242 and the membrane 104 have a substantially constant thickness. The constant thickness of the shapeable material 244, the conformable material 242 and the membrane 104 cause the membrane to have a substantially horizontal upper surface 254. The upper surface 254 allows substantially the entire image 102 on the membrane 104 to be simultaneously located in image transferring contact with the substrate 184. As pressure is added from the urging means the conformable material 242 urges the flexible membrane 104 to conform substantially to the surface of the substrate 184 thus transferring the image 102 thereto.

Preferably, in the above-described embodiments, air bubbles located between the membrane 104 and the substrate 184 are allowed to escape to reduce, or prevent, the likelihood of distorting the image 102.

Once the desired image 102 is transferred, the vertically translatable means of the substrate fixture 206 is energized by the controller 124 thereby vertically translating the substrate fixture 206 away from the membrane 104. The vertically translatable means of the forming fixture 206 is energized thereby separating the forming fixture 206 from the membrane 104 and allowing the membrane 104 to assume its pre-shaped flat form. The at least one pneumatic cylinder 222 connected to the pendulum 218 is energized thereby moving the substrate fixture 206 to the opening 224 in the transfer station frame 220. The controller 124 disengages the vacuum force 235 to the suction cups 234 and the printed substrate 184 is removed from the substrate fixture 206 either automatically or manually. A new substrate 184 may then be attached to the substrate fixture 206 as described above.

The controller 124 also energizes the electric motor connected to the frame supporting the membrane 104 to move them out of the transfer station 146. The membrane 104 may be located in the post-transfer station 266 as described above and/or transported to the print station 100 for re-application of the pigment-containing material 114.

In an alternative embodiment of the present invention, at least a second flexible membrane may be printed in substantially the same manner as described above with a similar or dissimilar image to the image on the first membrane and/or with a similar or dissimilar material. A second forming fixture constructed substantially as described above, is designed to urge the second membrane and the image printed thereon into image transferring contact with the substrate. Thus, overlapping and/or non-overlapping layers of similar or dissimilar material and/or images may be added to the substrate. Using this concept, a plurality of membranes and forming fixtures may be used to transfer two or more images to the substrate without departing from the scope or spirit of this invention. The first, and the at least second, forming fixture and first, and at least second, membranes may be located in a single transfer station or they may be located in first and second transfer stations, respectively, with substrate transfer means moving the substrate between the transfer stations.

In accordance with the provisions of the patent statutes, the present invention has been described in what is considered to represent its preferred embodiments, however, it should be noted that the invention can be practiced otherwise than as specifically illustrated and described without departing from its scope or spirit.

I claim:

1. An apparatus for printing on a substrate, comprising:

a substrate;

at least one flexible membrane having at least one image printed thereon;

at least one flexible forming fixture for shaping said at least one flexible membrane into a complementary shape to said substrate;

a means to transfer said at least one image from said at least one membrane to said substrate.

2. An apparatus for printing on a substrate, comprising:

a substrate;

a flexible membrane having a printed image thereon;

a flexible forming fixture for shaping said membrane into a complementary shape to said substrate; and a means to transfer said image from said membrane to said substrate.

3. The apparatus of claim 2, wherein said substrate has at least one surface for receiving said at least one image thereon.

4. The apparatus of claim 3, wherein at least a portion of said surface is planar.

5. The apparatus of claim 3, wherein at least a portion of said surface is curved.

6. The apparatus of claim 3, wherein at least a portion of said surface is concave.

7. The apparatus of claim 3, wherein at least a portion of said surface is convex.

8. The apparatus of claim 3, wherein at least a portion of said surface is compound.

9. The apparatus of claim 2, wherein said forming fixture is substantially planar.

10. The apparatus of claim 2, wherein said forming fixture has a first portion.

11. The apparatus of claim 10, wherein said forming fixture has at least a second portion.

12. The apparatus of claim 11 wherein said first portion has a first height.

13. The apparatus of claim 12, wherein said second portion has a second height.

14. The apparatus of claim 13, wherein said first height is greater than said second height.

15. The apparatus of claim 14, wherein said first portion is radially inward said second portion.

16. The apparatus of claim 14, wherein said first portion is radially outward said second portion.

17. The apparatus of claim 2, wherein said forming fixture is constructed of a conformable material.

18. The apparatus of claim 17, wherein said conformable material has a substantially complementary shape to said substrate.

19. The apparatus of claim 18, wherein said conformable material is located adjacent said shapable material.

20. The apparatus of claim 19, wherein said forming fixture is at least partially constructed of said shapable material.

21. The apparatus of claim 20, wherein said shapable material has a substantially complementary shape to said substrate.

22. The apparatus of claim 21, wherein said shapable material is removably secured to said base.

23. The apparatus of claim 2, wherein at least one source of motion is connected to said forming fixture to position said forming fixture adjacent said membrane.

24. The apparatus of claim 23, wherein at least one locking mechanism selectively engages said forming fixture to prevent movement thereof.

25. The apparatus of claim 2, wherein a barrier material is located over said forming fixture.

26. The apparatus of claim 2, wherein said membrane is constructed of a silicone compound.

27. The apparatus of claim 2, wherein said membrane has a mesh embedded therein.

28. The apparatus of claim 2, wherein said membrane has a first layer for receiving a pigment-containing material.

29. The apparatus of claim 28, wherein said membrane has said first layer and at least a second layer.

30. The apparatus of claim 29, wherein said first membrane layer is harder than said second layer.

31. The apparatus of claim 29, wherein said first membrane layer is softer than said second layer.

32. The apparatus of claim 2, wherein said membrane has a substantially planar upper surface.

33. The apparatus of claim 2, wherein said membrane has a substantially constant thickness.

34. The apparatus of claim 2, wherein said membrane has an upper surface having a first portion with a first height and at least a second portion with a second height.

35. The apparatus of claim 34, wherein said first height is greater than said second height.

36. The apparatus of claim 35, wherein said first height is radially inward said second height.

37. The apparatus of claim 35, wherein said first height is radially outward said second height.

38. The apparatus of claim 2, wherein said membrane is connected to a tensioning system for locating and relieving tension in said membrane.

39. The apparatus of claim 38, wherein said tensioning system has an adjustable frame.

40. The apparatus of claim 39, wherein said adjustable frame is connected to at least one rack and pinion system.

41. The apparatus of claim 39, wherein clamps secure said membrane to said adjustable frame.

42. The apparatus of claim 2, wherein said substrate is removably secured by a substrate fixture.

43. The apparatus of claim 42, wherein said substrate fixture has a complementary surface to said substrate.

44. The apparatus of claim 42, wherein said substrate fixture has means to position said substrate thereon.

45. The apparatus of claim 2, wherein said substrate fixture is secured to a means to locate said substrate fixture adjacent said membrane.

46. The apparatus of claim 25, wherein at least one automatically controlled electric motor locates said substrate fixture adjacent said membrane.

47. An apparatus for printing on a substrate, comprising:

at least one print station for printing a flexible membrane with at least one image;

at least one transfer station for transferring said at least one printed image on said flexible membrane to a surface of a substrate, said transfer station having a forming fixture for shaping said membrane into a complementary shape to said surface of said substrate;

a substrate fixture having means to removably secure said substrate thereon; and a means for urging said membrane into image transferring contact with said substrate.

48. The apparatus of claim 47, wherein said print station prints a pigment-containing material on said membrane.

49. The apparatus of claim 48, wherein said print station has at least one print head.

50. The apparatus of claim 48, wherein said print station is a membrane printing station.

51. The apparatus of claim 47, wherein said print station has a means for maintaining said pigment-containing material in a printable condition.

52. The apparatus of claim 51, wherein said means for maintaining said pigment-containing material in a printable condition is a medium for receiving pigment-containing material and a means for selectively moving said medium into and out of said print station.

53. The apparatus of claim 52, wherein said medium for receiving pigment-containing material is paper.

54. The apparatus of claim 47, further comprising a means for selectively moving said membrane between at least said print station and said transfer station.

55. The apparatus of claim 54, wherein said means for selectively moving said membrane has a frame for adjustably receiving said membrane, a track and a source of motion connected to said frame.

56. The apparatus of claim 55, wherein said track extends at least to said transfer station and said print station.

57. The apparatus of claim 48, further comprising at least one preconditioning station.

58. The apparatus of claim 57, wherein said preconditioning station has means for conditioning said pigment-containing material on said membrane.

59. The apparatus of claim 47, further comprising at least one curing station.

60. The apparatus of claim 59, wherein said at least one curing station has a means for curing said transferred image on said substrate.

61. A method for printing on a substrate, comprising:

Providing a substrate having a surface;

Providing a plurality of flexible membranes having printed images thereon; and

Locating at least one flexible forming fixture adjacent said flexible membranes to shape said membranes into a complementary shape to said substrate; and Transferring said printed images from said flexible membranes to said substrate.

62. A method for printing on a substrate, comprising:

providing a substrate having a surface;

providing a flexible membrane having a printed image thereon; and locating a flexible forming fixture adjacent said flexible membrane to shape said membrane into a complementary shape to said substrate; and transferring said printed image from said flexible membrane to said substrate.

63. The method of claim 62, wherein said substrate is removably secured in a substrate fixture.

64. The method of claim 63, wherein said substrate is manually located in a substrate fixture.

65. The method of claim 63, wherein said substrate is automatically located in a substrate fixture.

66. The method of claim 62, wherein tension in said membrane is released.

67. The method of claim 62, wherein said substrate is located adjacent said membrane.

68. The method of claim 62, wherein a barrier material is located substantially over said forming fixture.

69. The method of claim 62, wherein said forming fixture has a portion that urges a printed portion of said membrane into contact with a portion of said substrate to transfer a portion of said image to said substrate.

70. The method of claim 69, wherein said forming fixture has a first portion and at least a second portion, said first portion initially urges a first printed portion of said membrane into contact with a first portion of said substrate to transfer a first portion of said image to said substrate, said second portion subsequently urges a second printed portion of said membrane into contact with a second portion of said substrate to transfer a second portion of said image to said substrate.

71. The method of claim 70, wherein said first portion of said forming fixture is compressed and conforms said first printed portion of said membrane to said first portion of said substrate as said first portion of said membrane contacts said first portion of said substrate.

72. The method of claim 70, wherein said at least said second portion of said forming fixture is compressed and conforms said second printed portion of said membrane to said second portion of said substrate as said second portion of said membrane contacts said second portion of said substrate.

73. The method of claim 70, wherein said first portion of said forming fixture is located radially inward said second portion of said forming fixture.

74. The method of claim 70, wherein said first portion of said forming fixture is located radially outward from said second portion of said forming fixture.

75. The method of claim 70, wherein said forming fixture has successive portions to said first and said second portions, said successive portions urge successive printed portions of said membrane into contact with successive portions of said substrate to transfer successive portions of said image to said substrate.

76. The method of claim 75, wherein said successive portions of said forming fixture are compressed and conform said successive printed portions of said membrane to said successive portions of said substrate as said successive portions of said membrane contact said successive portions of said substrate.

77. The method of claim 75, wherein said successive portions of said forming fixture are radially outward from said first and said second portions of said forming fixture.

78. The method of claim 75, wherein said successive portions of said forming fixture are radially inward from said first and said second portions of said forming fixture.

79. The method of claim 75, wherein said successive portions of said forming fixture are located radially inward and radially outward from said first and said second portions.

80. The method of claim 62, wherein air bubbles located between said membrane and said substrate are forced out.

81. The method of claim 62, wherein said printed image on said membrane is transferred substantially simultaneously to said substrate.

82. The method of claim 62, wherein said membrane has a first height portion and at least a second height portion, said first height portion is urged into image transferring contact with a first portion of said substrate to transfer a first portion of said image to said substrate and said second height portion is subsequently urged into image transferring contact with a second portion of said substrate to transfer a second portion of said image to said substrate.

83. The method of claim 82, wherein said first portion of said membrane conforms to said first portion of said substrate.

84. The method of claim 82, wherein said second portion of said membrane conforms to said second portion of said substrate.

85. The method of claim 82, wherein said first portion of said membrane is located radially inward from said second portion of said membrane.

86. The method of claim 82, wherein said first portion of said membrane is located radially outward from said second portion of said membrane.

87. The method of claim 82, wherein said membrane has successive portions to said first and said second height portions, said successive portions are urged into successive image transferring contact with said substrate.

88. The method of claim 87, wherein said successive portions of said membrane are radially outward from said first and said second height portions of said membrane.

89. The method of claim 87, wherein said successive portions of said membrane are radially inward from said first and said second height portions of said membrane.

90. The method of claim 87, wherein said successive portions of said membrane are radially outward and inward from said first and said second portion of said membrane.

91. The method of claim 62, further comprising separating said membrane from said substrate after said membrane is located into image transferring contact with said substrate.

92. The method of claim 62, further comprising removing said printed substrate from said substrate fixture.

93. A method for printing on a substrate, comprising:

providing at least one print station for printing a flexible membrane with at least one image;

providing at least one transfer station for transferring said at least one printed image on said flexible membrane to a surface of a substrate, said transfer station having a forming fixture for shaping said membrane into a complementary shape to said surface of said substrate;

a substrate fixture for removably securing said substrate thereon; and urging said membrane into image transferring contact with said substrate.

94. The method of claim 93, further comprising moving said membrane between at least said print station and said transfer station.

95. The method of claim 94, wherein said membrane is moved to said transfer station after printing an image thereon.

96. The method of claim 94, wherein said membrane is moved to said print station after said image located thereon is transferred to said substrate.

97. The method of claim 93, wherein said membrane is attached to at least one tensioning system for locating and releasing tension in said membrane.

98. The method of claim 97, wherein said membrane is tensioned to flatten said membrane and said image is printed thereon.

99. The method of claim 93, wherein a support structure is located adjacent said membrane to support said membrane during printing.

100. The method of claim 93, wherein said flexible membrane is printed by distributing pigment-containing material on a membrane having a image thereon and urging said pigment-containing material through selected portions of said image onto said membrane.

101. The method of claim 100, wherein said pigment-containing material is maintained in a printable condition by selectively urging said pigment-containing material through said membrane onto a pigment-containing material receiving medium.

102. The method of claim 101, wherein said pigment-containing material receiving medium is moved into said print station, printed, and removed from said print station at pre-determined times.

103. The method of claim 93, wherein said flexible membrane is printed by distributing pigment-containing material with a print head onto said membrane.

104. The method of claim 93, wherein said substrate is positioned adjacent at least one retractable positioning pin in said substrate fixture for positioning said substrate in a pre-determined location on said fixture.

105. The method of claim 104, wherein said at least one retractable positioning pin retracts into said substrate fixture at a predetermined time.

106. The method of claim 100, further comprising conditioning said pigment-containing material.

107. The method of claim 106, wherein said conditioning is heating said pigment-containing material.

108. The method of claim 106, wherein said conditioning is humidifying said pigment-containing material.

109. The method of claim 106, wherein said conditioning is drying said pigment-containing material.

110. The method of claim 106, wherein said conditioning occurs in a pre-conditioning station.

111. The method of claim 93, wherein a first image is transferred to said substrate, said first image is cured on said substrate and at least a second image is transferred to said substrate.

* * * * *